US005106711A

United States Patent [19]

Kawamura et al.

[11] Patent Number: 5,106,711

[45] Date of Patent: * Apr. 21, 1992

[54] ELECTROPHOTOGRAPHIC SENSITIVE MEMBER

[75] Inventors: Takao Kawamura, 17-11, 1-cho, Takakuradai, Sakai-shi, Osaka-fu; Naooki Miyamoto; Hitoshi Takemura, both of Yohkaichi; Satoru Watanabe; Kokichi Ishibitsu, both of Yohkaichi, all of Japan

[73] Assignees: Kyocera Corporation, Kyoto; Takao Kawamura, Osaka, both of Japan

[ * ] Notice: The portion of the term of this patent subsequent to Nov. 21, 2006 has been disclaimed.

[21] Appl. No.: 336,891

[22] Filed: Apr. 12, 1989

[30] Foreign Application Priority Data

| | | | |
|---|---|---|---|
| Apr. 25, 1988 | [JP] | Japan | 63-102047 |
| Apr. 25, 1988 | [JP] | Japan | 63-102048 |
| Apr. 27, 1988 | [JP] | Japan | 63-104991 |
| Apr. 27, 1988 | [JP] | Japan | 63-104992 |
| Apr. 28, 1988 | [JP] | Japan | 63-106598 |
| Apr. 28, 1988 | [JP] | Japan | 63-106599 |

[51] Int. Cl.[5] ..... G03G 15/00; G03G 15/04; G03G 15/08

[52] U.S. Cl. ..... 430/56; 430/69; 430/95

[58] Field of Search ..... 430/56, 69, 66, 67, 430/57, 95

[56] References Cited

U.S. PATENT DOCUMENTS

| | | | |
|---|---|---|---|
| 4,403,026 | 9/1983 | Shimizu et al. | 430/65 |
| 4,471,042 | 9/1984 | Komatsu | 430/64 |
| 4,532,150 | 7/1985 | Endo et al. | 427/39 |
| 4,859,554 | 8/1989 | Yamazaki et al. | 430/58 |
| 4,882,252 | 11/1990 | Kawamura et al. | 430/58 |

FOREIGN PATENT DOCUMENTS

| | | | |
|---|---|---|---|
| 3245500 | 6/1984 | Fed. Rep. of Germany | 430/95 |
| 58-106546 | 6/1983 | Japan . | |
| 60-118844 | 6/1985 | Japan . | |
| 2039872 | 2/1987 | Japan | 430/95 |
| 3081435 | 4/1988 | Japan | 430/57 |
| 3081439 | 4/1988 | Japan | 430/57 |
| 3081440 | 4/1988 | Japan | 430/57 |
| 3081441 | 4/1988 | Japan | 430/57 |
| 3081443 | 4/1988 | Japan | 430/57 |
| 3081444 | 4/1988 | Japan | 430/57 |

*Primary Examiner*—Marion E. McCamish
*Assistant Examiner*—Stephen C. Crossan
*Attorney, Agent, or Firm*—Spensley Horn Jubas & Lubitz

[57] ABSTRACT

The present invention relates to an electrophotographic sensitive member comprising a photoconductive amorphous silicon carbide layer.

An amorphous silicon layer has superior abrasion resistance, heat resistance, antipollution property, photosensitive characteristic and the like.

However, an amorphous silicon layer itself has a low dark resistance, so that dopants, such as boron, are added thereto but a dark resistance of $10^{12}\Omega\cdot$cm or more required for the case where it is used as an electrophotographic sensitive member has never been obtained.

The present inventors have found before that an amorphous silicon carbide layer has a large carrier-mobility and photoconductivity and its dark resistance of $10^{13}\Omega\cdot$cm or more can be easily obtained regardless of the existence of dopants and furthermore an electrophotographic sensitive member, which can be positively and negatively charged by the selection of the dopants, can be obtained. The present invention provides an electrophotographic sensitive member capable of improving the photosensitive characteristics and the like to improve electrophotographic characteristics, as desired, with an a-SiC layer as a substantial photoconductive layer and substantially without requiring a surface protective layer and a barrier layer.

6 Claims, 11 Drawing Sheets

ELECTROPHOTOGRAPHIC SENSITIVE MEMBER

BACKGROUND OF THE INVENTION

The present invention relates to an electrophotographic sensitive member comprising a photoconductive amorphous silicon carbide layer.

Recently, the progress of the electrophotographic sensitive member is remarkable and various kinds of characteristic have been required for also a photosensitive member itself with the development of a copying machine, a printer and the like carrying the photosensitive member thereon.

An amorphous silicon layer has been watched with interest for this requirement on account of its superiority in heat resistance, abrasion resistance, antipollution property, photosensitive characteristic and the like.

However, the amorphous silicon layer (hereinafter called a-Si for short) has a dark resistance of merely about $10^9\Omega\cdot$cm if it contains no impurity as a dopant and in the case where it is used in the electrophotographic sensitive member, it is necessary to give the dark resistance of $10^{12}$ $\Omega\cdot$cm or more, whereby enhancing a charge-retentivity. To that end, boron and the like have been added but no sufficiently satisfactory dark resistance bas been obtained, that is, merely a dark resistance of about $10^{11}$ $\Omega\cdot$cm has been obtained.

On the other hand, a multi-layer type photosensitive member comprising an a-Si photoconductive layer and other non-photoconductive layer overlapped on said a-Si photoconductive layer has been proposed with the development of the above described dopants.

For example, FIG. 1 shows such a multi-layer type photosensitive member comprising a substrate (1) and a barrier layer (2), and a-Si photoconductive layer (3) and a surface protective layer (4) formed on said substrate (1) in this order.

With this multi-layer type photosensitive member, the barrier layer (2) aims at the prevention of carriers from entering from the substrate (1) and the surface protective layer (4) aims at the protection of the a-Si photoconductive layer (3) to improve the moisture resistance and the like but both layers (2), (4) aim at the increase of the dark resistance of the photosensitive member to enhance the charge acceptance. Accordingly, it is not required to make these layers photoelectrically conductive.

As above described, the conventional well-known a-Si photosensitive member is characterized by that a photocarrier-generating layer is formed of the a-Si photoconductive layer, whereby having superior advantages in heat resistance, durability, photosensitivity characteristic and the like but on the contrary it has an insufficient dark resistance, and accordingly, the dopants have been used and the dark resistance has been enhanced by forming a multi-layer type photosensitive member. That is to say, the barrier layer (2) and the surface protective layer (4) formed in the multi-layer type photosensitive member aim at the elimination of the disadvantages incidental to the a-Si photoconductive layer itself, and accordingly, it can be said that the are the layers which can be substantially discriminated from the a-Si photoconductive layer (3).

In view of the above described circumstances, the present inventors have already found that amorphous silicon carbide (hereinafter called a-SiC for short) has the photoelectric conductivity and its dark resistance easily amounts to $10^{13}$ $\Omega\cdot$cm or more regardless of the existence of the dopants, and besides, it can form an electrophotographic sensitive member which can be positively and negatively charged by the selection of the dopants.

It is the reason why the above described a-SiC layer could form the electrophotographic sensitive member that the a-SiC layer has a large carrier-mobility and a dark conductivity of $10^{-13}$ $(\Omega\cdot\text{cm})^{-1}$ or less, whereby the large charge acceptance could be obtained.

However, still more superior electrophotographic characteristics are desired even for the a-SiC electrophotographic sensitive member having such a large carrier-mobility with the progress of the development of instruments on which the photosensitive member is placed. For example, in the case where the photosensitive characteristics can not sufficiently meet the use required, the background smearing occurs on the image and the residual potential is increased.

SUMMARY OF THE INVENTION

Accordingly, the present invention has been achieved in view of the above described matters.

Thus, it is an object of the present invention to provide an electrophotographic sensitive member capable of improving the photosensitive characteristics and the like to improve the electrophotographic characteristics as desired with the a-SiC layer as the substantial photoconductive layer and substantially without requiring the surface protective layer and the barrier layer.

That is to say, it is a first object of the present invention to provide an electrophotographic sensitive member comprising a photoconductive a-SiC layer formed on a substrate, characterized by that said a-SiC layer is provided with at least a first layer zone and a second layer zone, said first layer zone being disposed on a side closer to the substrate than said second layer zone, elements of the group IIIa in the Periodic table (hereinafter called elements of the group IIIa for short) being contained in the second layer zone in a quantity of 0.1 to 10,000 ppm less than in the first layer zone, and oxygen being contained in the second layer zone in a quantity of $5\times10^{-5}$ to 1 atomic %. It is a second object of the present invention to provide an electrophotographic sensitive member comprising a photoconductive amorphous silicon carbide layer formed on a substrate, characterized by that said amorphous silicon carbide layer is provided with at least a first layer zone and a second layer zone, said first layer zone being disposed on a side closer to the substrate than said second layer zone, elements of the group Va in the periodic table being contained in the second layer zone in a quantity of 0 to 10,000 ppm less than in the first layer, and oxygen being contained in the second layer zone in a quantity of $5\times10^{-5}$ to 1 atomic %. In addition, it is a third object of the present invention to provide an electrophotographic sensitive member comprising a photoconductive a-SiC layer formed on a substrate, characterized by that said a-SiC layer is provided with at least a first layer zone, a second layer zone and a third layer zone, said first layer zone being disposed on a side closer to the substrate than said second layer zone, said second layer zone being disposed on a side closer to the substrate than said third layer zone, carbon being contained in the third layer zone in a quantity larger than in the second layer zone, elements of the group IIIa in the periodic table being contained in the second layer zone in a quantity of 0.1 to 10,000 ppm less than in the first layer zone, and oxygen being contained in at least one of the second layer zone and the third layer zone in a quantity of $5\times10^{-5}$ to 1 atomic %. It is a fourth object of the present invention to provide an electrophotographic sensitive member comprising a photoconductive amorphous silicon carbide layer formed on a substrate, characterized by that said amorphous silicon carbide layer is provided with at least a first layer zone, a second layer zone and a third layer zone, said first layer being disposed on a side closer to the substrate than said second layer zone, said second layer zone being disposed on a side closer to the substrate than said third layer zone, carbon being contained in the third layer zone in a quantity larger than in the second layer zone, elements of the group Va in the periodic table being contained in the second layer zone in a quantity of 0 o 10,000 ppm less than in the first layer zone, and oxygen being contained in at least one of the second layer zone and the third layer zone in a quantity of $5\times10^{-5}$ to 1 atomic %.

Furthermore, it is a fifth object of the present invention to provide an electrophotographic sensitive member comprising a photoconductive a-SiC layer formed on a substrate, characterized by that said a-SiC layer is provided with at least a first layer zone, a second layer zone, a third layer zone and a fourth layer zone, said first layer zone being disposed on a side closer to the substrate than said second layer zone, said second layer zone being disposed on a side closer to the substrate than said third layer zone, said third layer zone being disposed on a side closer to the substrate than said fourth layer zone, carbon being contained in the third layer zone in a quantity larger than in the second layer zone, carbon being contained in the fourth layer zone in a quantity larger than in the third layer zone, elements of the group IIIa in the periodic table being contained in the second layer zone in a quantity of 0.1 to 10,000 ppm less than in the first layer zone, and oxygen being contained in at least one of the second layer zone and the third layer zone in a quantity of $5\times10^{-5}$ to 1 atomic %. It is a sixth object of the present invention to provide an electrophotographic sensitive member comprising a photoconductive amorphous silicon carbide layer formed on a substrate, characterized by that said amorphous silicon carbide layer is provided with at least a first layer zone, a second layer zone, a third layer zone and a fourth layer zone, said first layer zone being disposed on a side closer to the substrate than said second layer zone, said second layer zone being disposed on a side closer to the substrate than said third layer zone, said third layer zone being disposed on a side closer to the substrate than said fourth layer zone, the third layer zone containing carbon in a quantity larger than in the second layer zone, the fourth layer zone containing carbon in a quantity larger than in the third layer zone, the second layer zone containing the Va group elements in the periodic table in a quantity of 0 to 10,000 ppm which is smaller than in the first layer zone, and at least one of the second layer zone and the third layer zone containing oxygen in a quantity of $5\times10^{-5}$ to 1 atomic %.

DETAILED DESCRIPTION OF THE INVENTION

Figure 1:
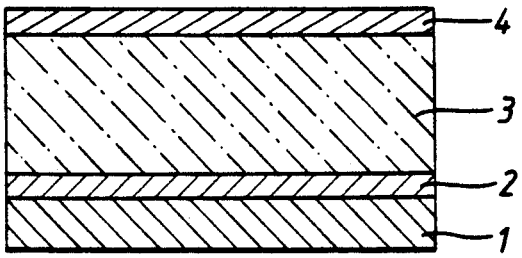
FIG. 1 is a sectional view showing a layer structure of the conventional electrophotographic sensitive member.
Figure 2A:
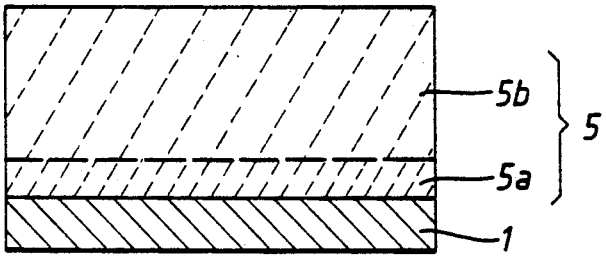
FIGS. 2A, 2B and 2C are sectional views showing a layer structure of an electrophotographic sensitive member according to the present invention.

FIG. 2A shows an electrophotographic sensitive member according to the first and second inventions of the present invention. Referring to FIG. 2A, a photoconductive a-SiC layer (5) is formed on an electrically conductive substrate (1), said layer (5) comprising a first layer zone (5*a*) and a second layer zone (5*b*) corresponding to a content of the IIIa group elements or the Va group elements.

In the case where the IIIa group elements or the Va group elements are contained in the a-SiC layer (5) in a quantity within the appointed range, the electrophotographic sensitive member according to the first invention and the second invention can be positively or negatively charged. In addition, it is characterized by that the charge acceptance and photosensitivity are improved and the photosensitivity can be still further improved by containing oxygen in the second layer zone (5*b*) in a quantity within the appointed range.

Figure 2B:
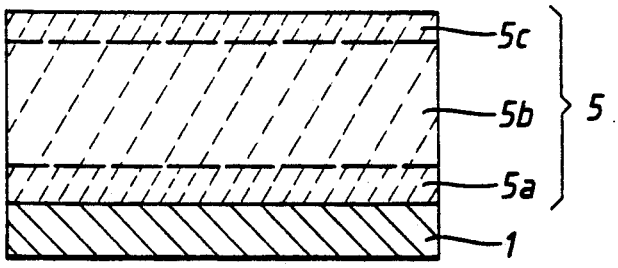

FIG. 2B shows an electrophotographic sensitive member according to the third invention and the fourth invention of the present invention. Referring to FIG. 2B, a photoconductive a-SiC layer (5) is formed on an electrically conductive substrate (1), said layer (5) comprises a first layer zone (5*a*), a second layer zone (5*b*) and a third layer zone (5*c*) corresponding to a content of the IIIa group elements or the Va group elements or carbon.

The electrophotographic sensitive member according to the third and fourth inventions is characterized by that, in the case where the IIIa group elements or the Va group elements are contained in the second layer zone (5*b*), it can be positively or negatively charged and improved also in charge acceptance and photosensitivity, and the charge acceptance can be still further enhanced by forming the third layer zone (5*c*) and the photosensitivity can be still further improved by containing oxygen in the second layer zone (5*b*) and/or the third layer zone (5*c*) in a quantity within the appointed range.

Figure 2C:
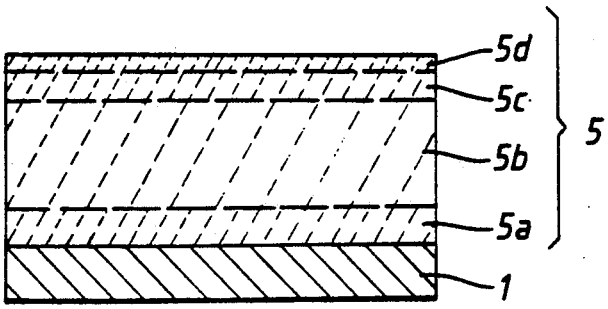
Figure 3:
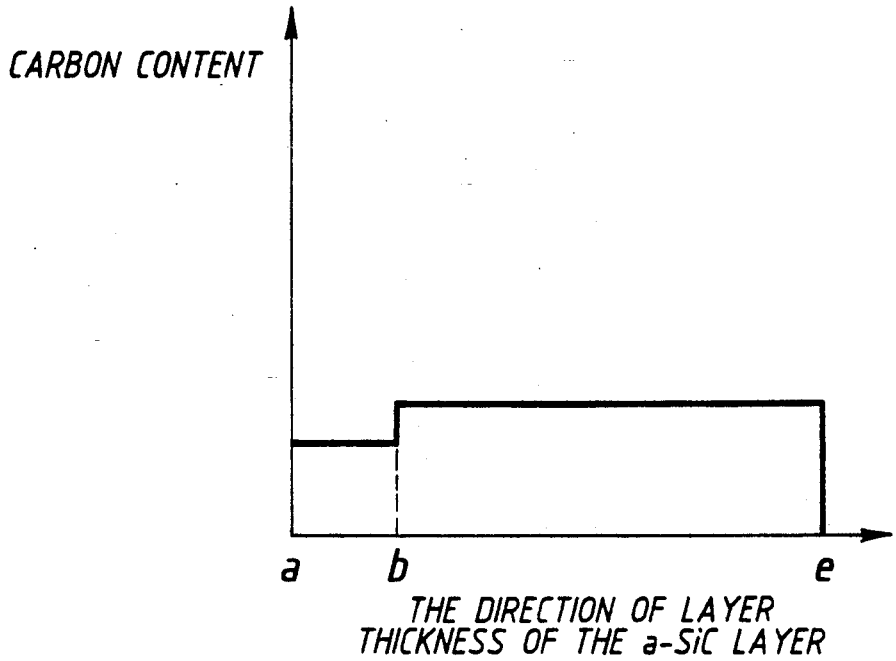
FIGS. 3 to 17 is a graph showing a carbon-content in the electrophotographic sensitive member according to the present invention, respectively.
Figure 4:
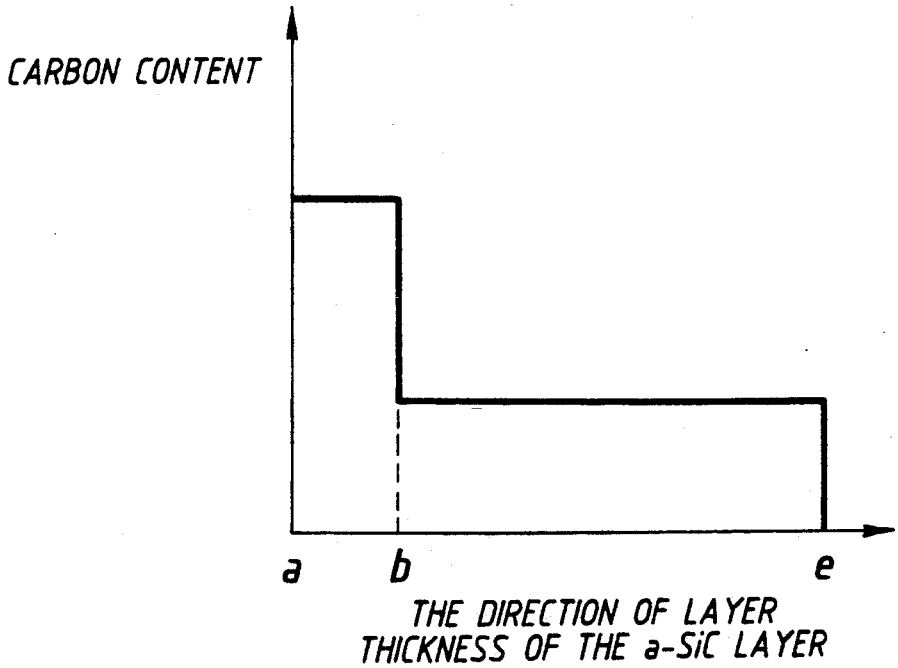
Figure 5:
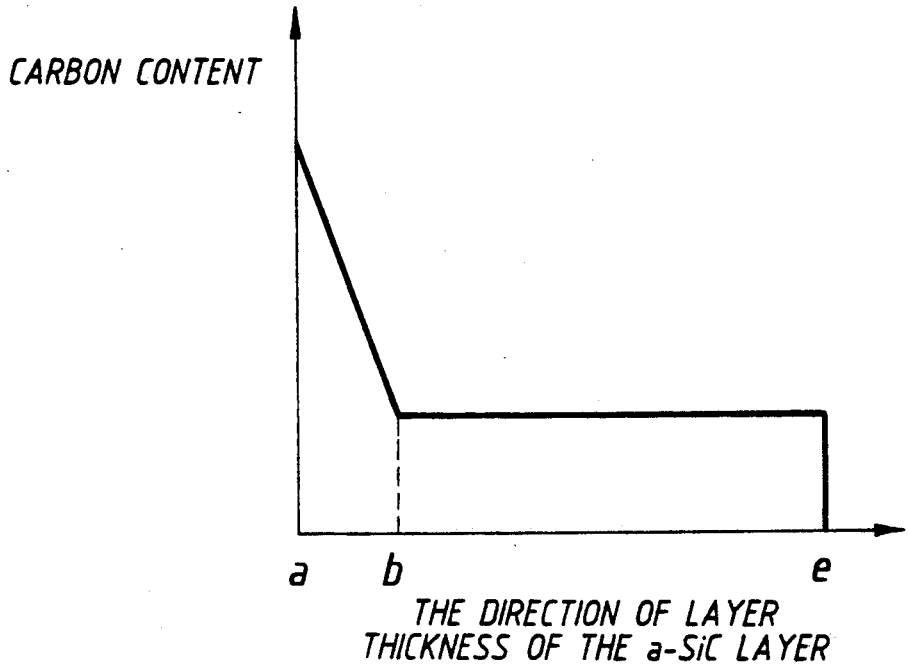
Figure 6:
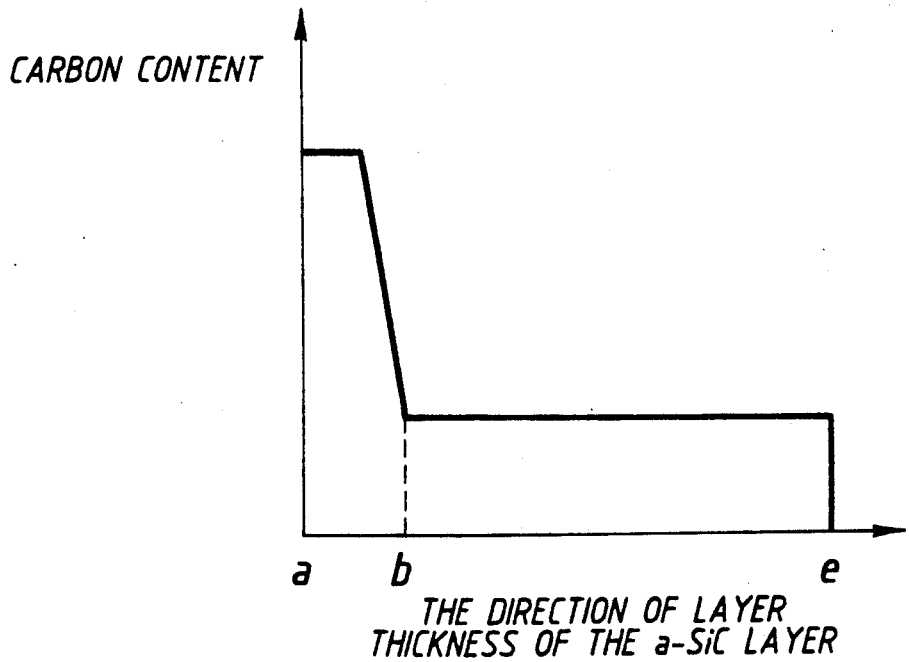
Figure 7:
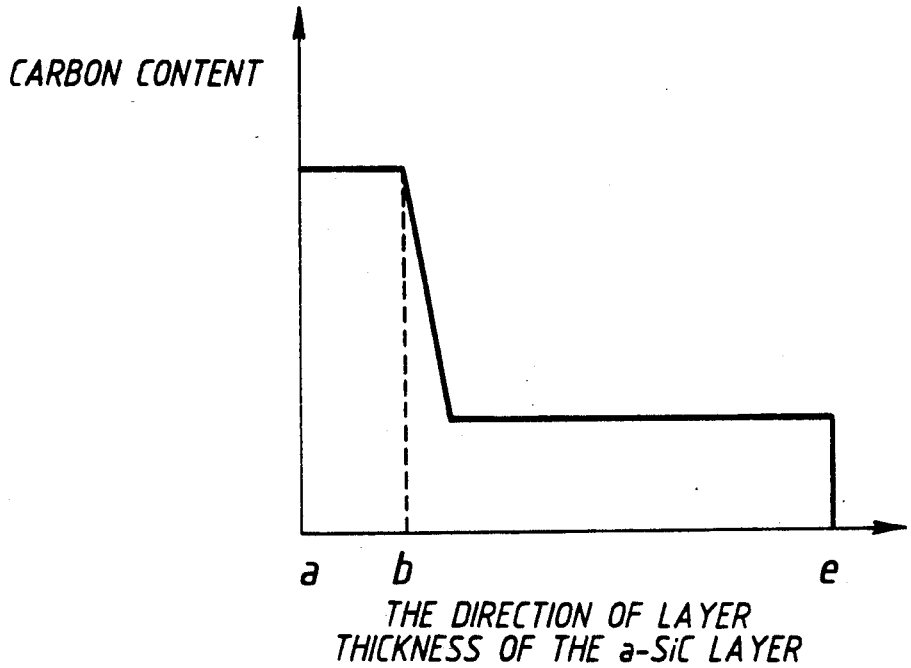
Figure 8:
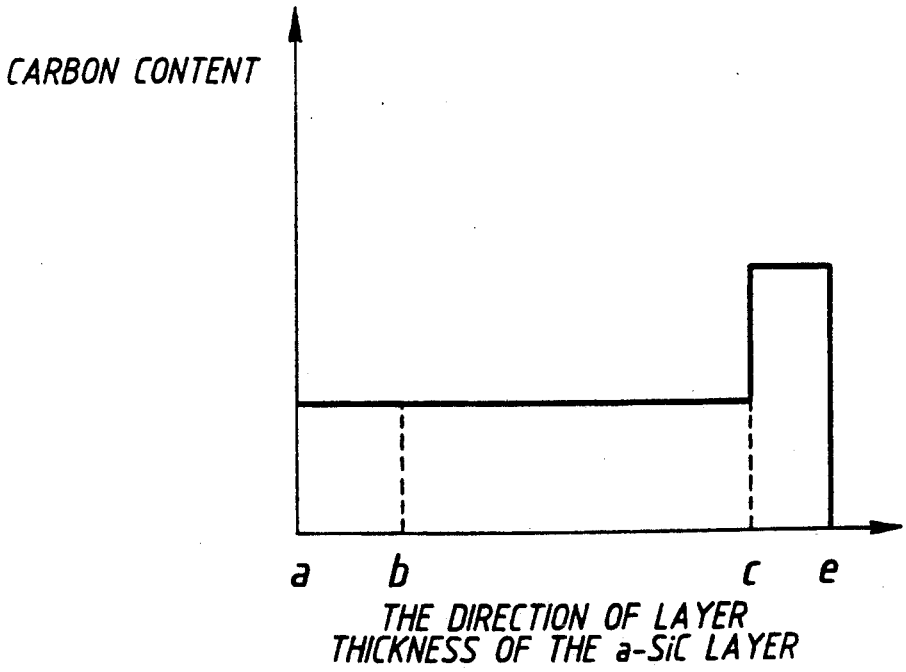
Figure 9:
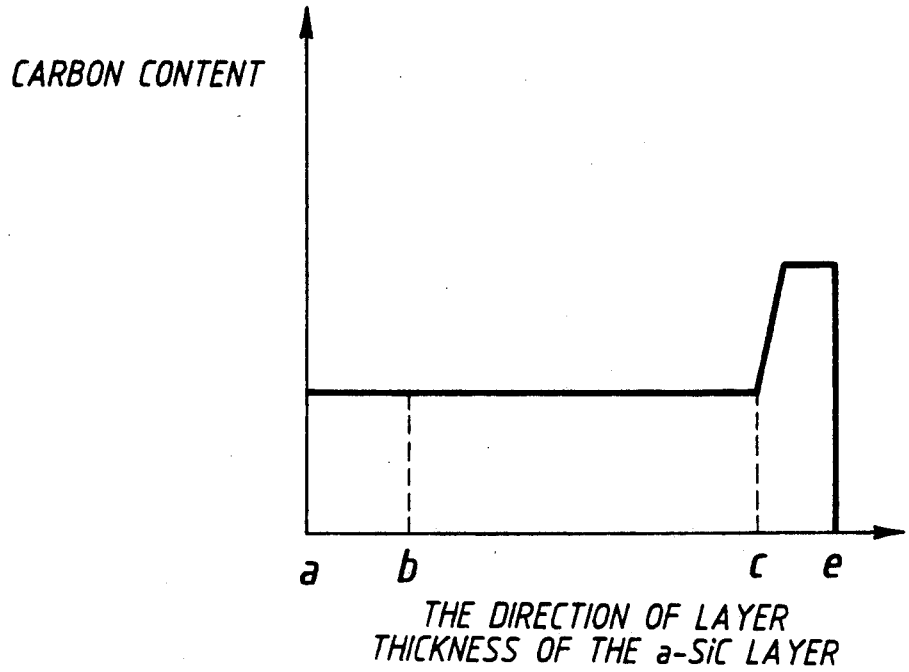
Figure 10:
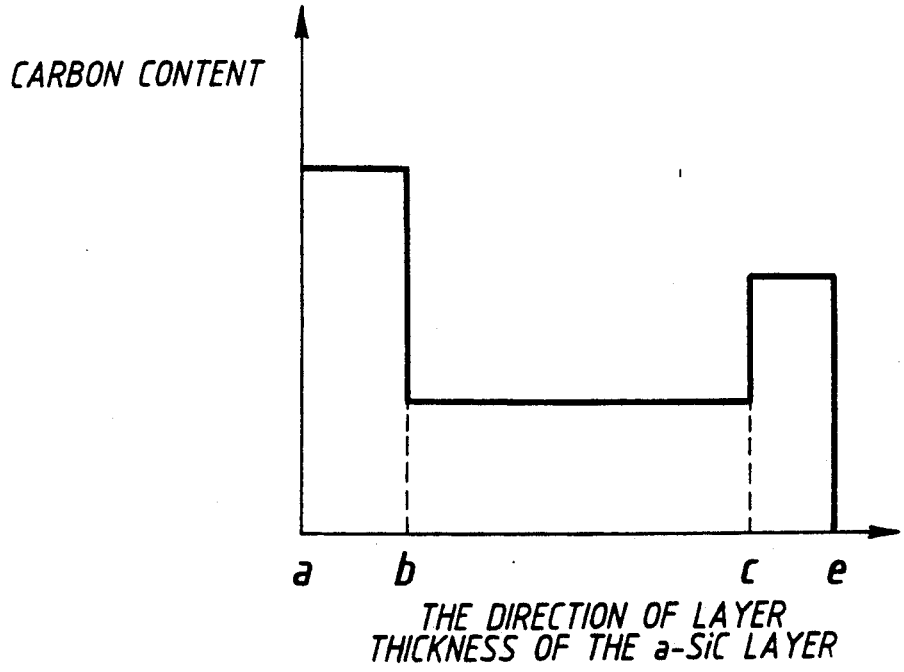
Figure 11:
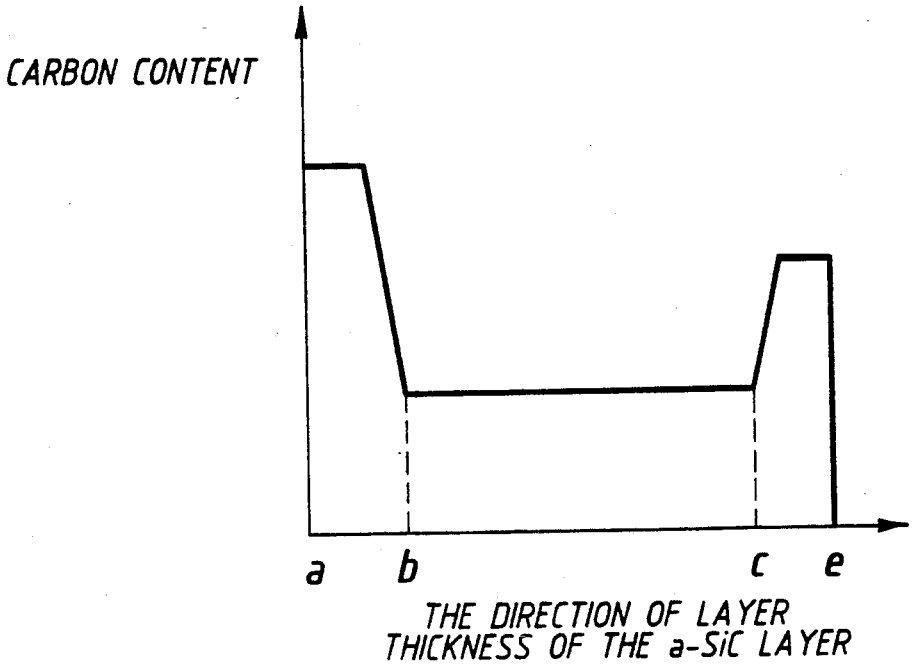
Figure 12:
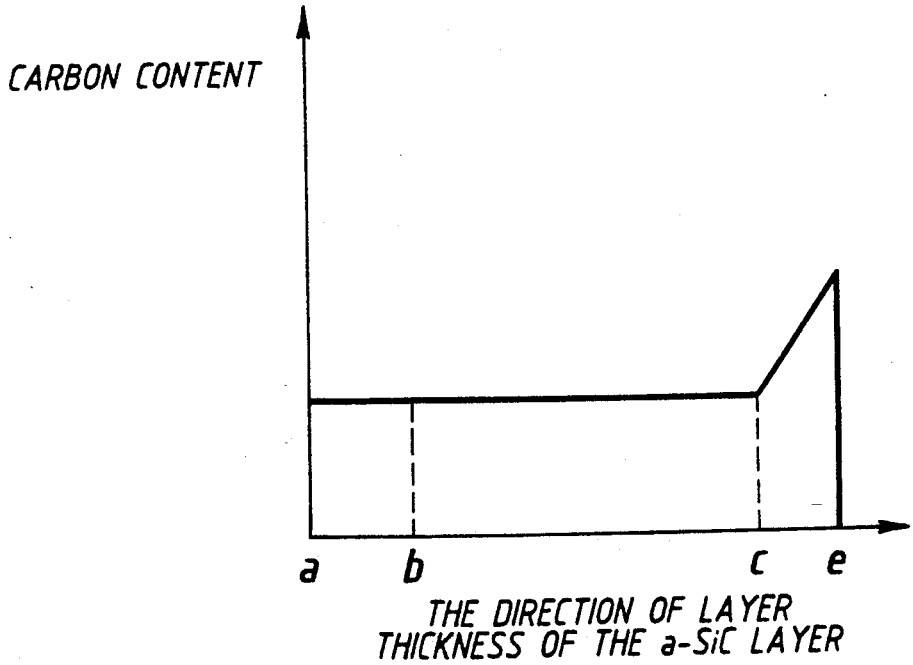
Figure 13:
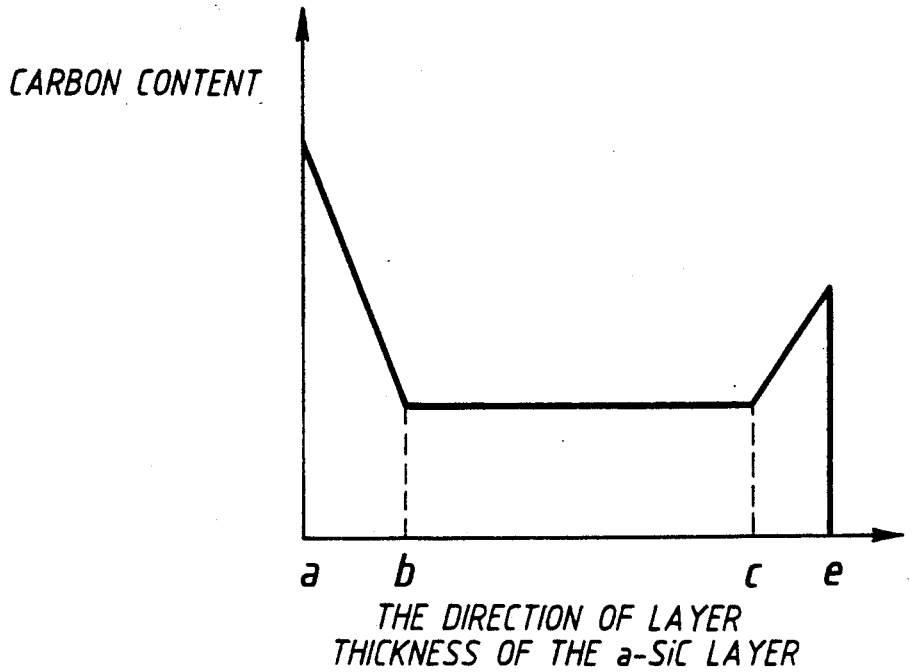
Figure 14:
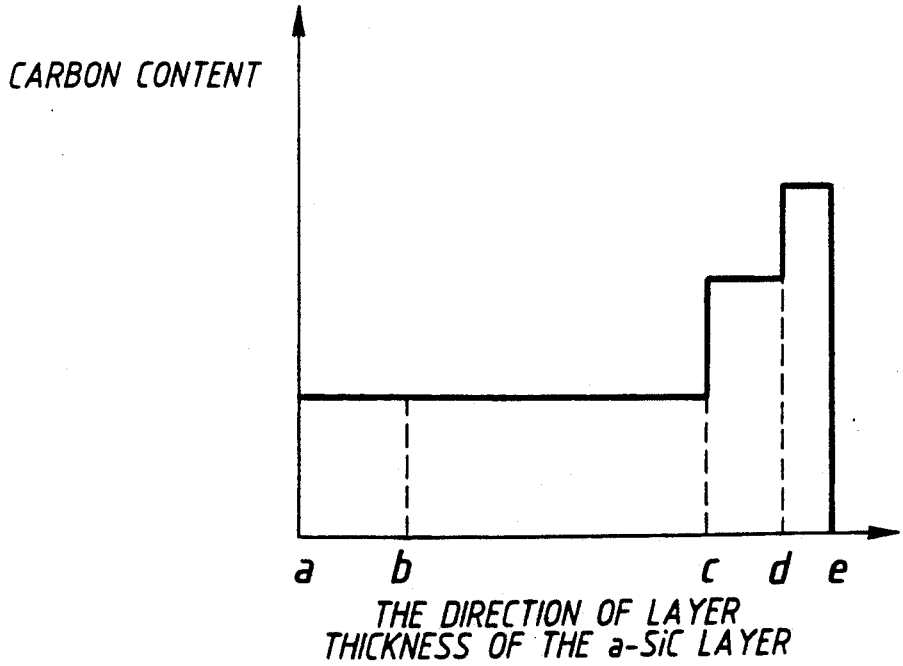
Figure 15:
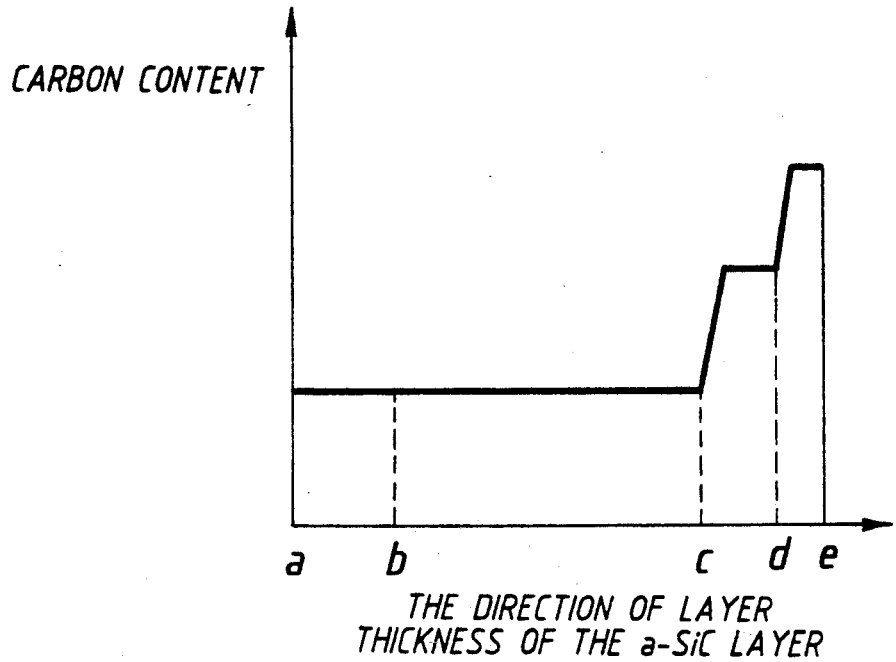
Figure 16:
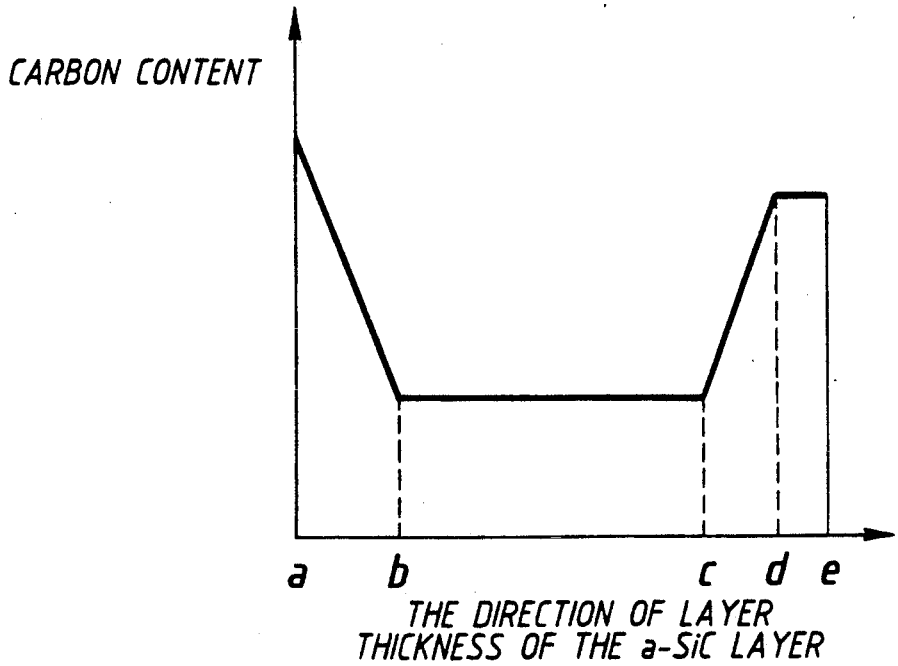
Figure 17:
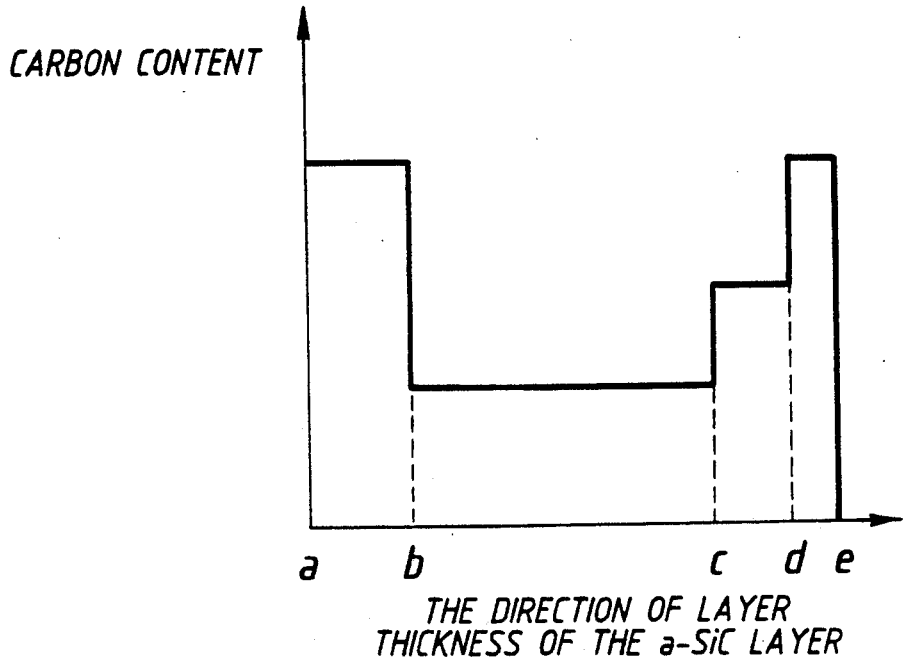
Figure 18:
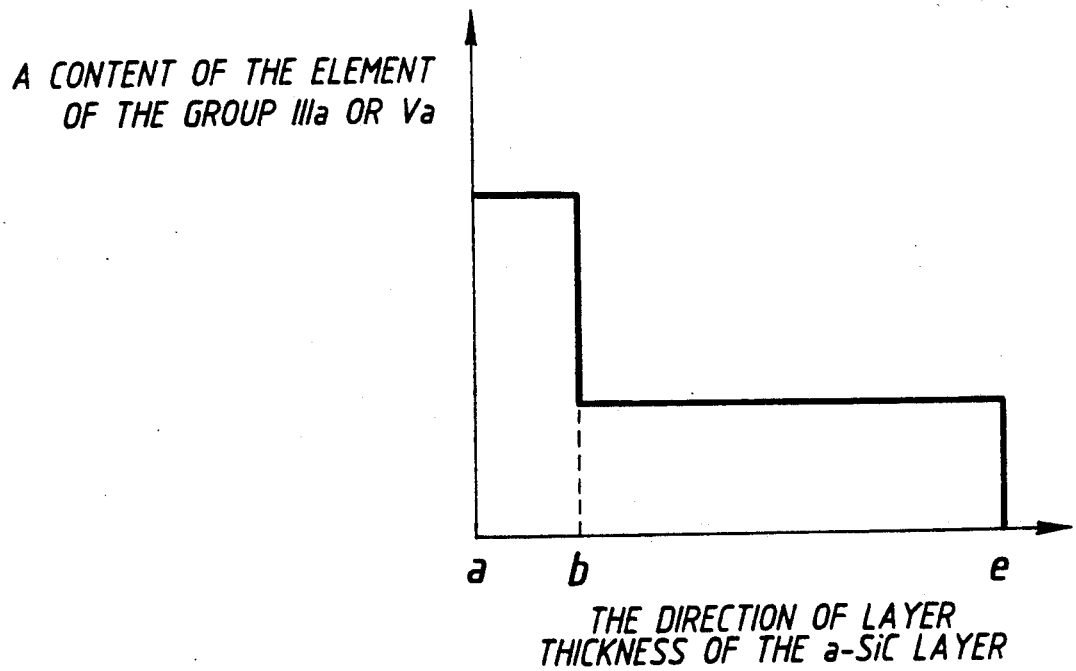
FIGS. 18 to 21 is a graph showing a content of the IIIa group elements or the Va group elements in the electrophotographic sensitive member according to the present invention, respectively.
Figure 19:
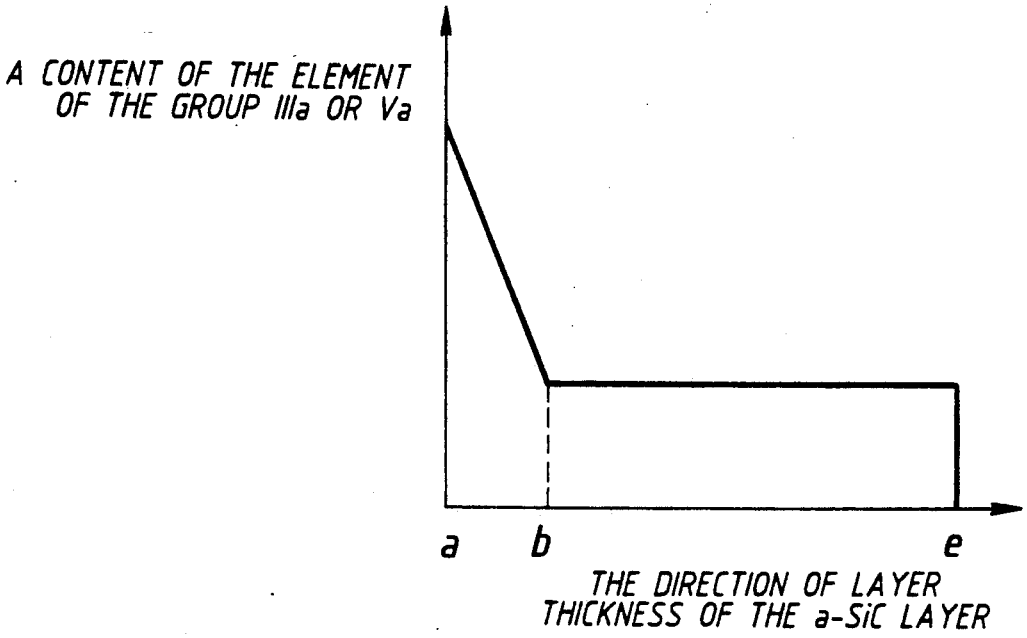
Figure 20:
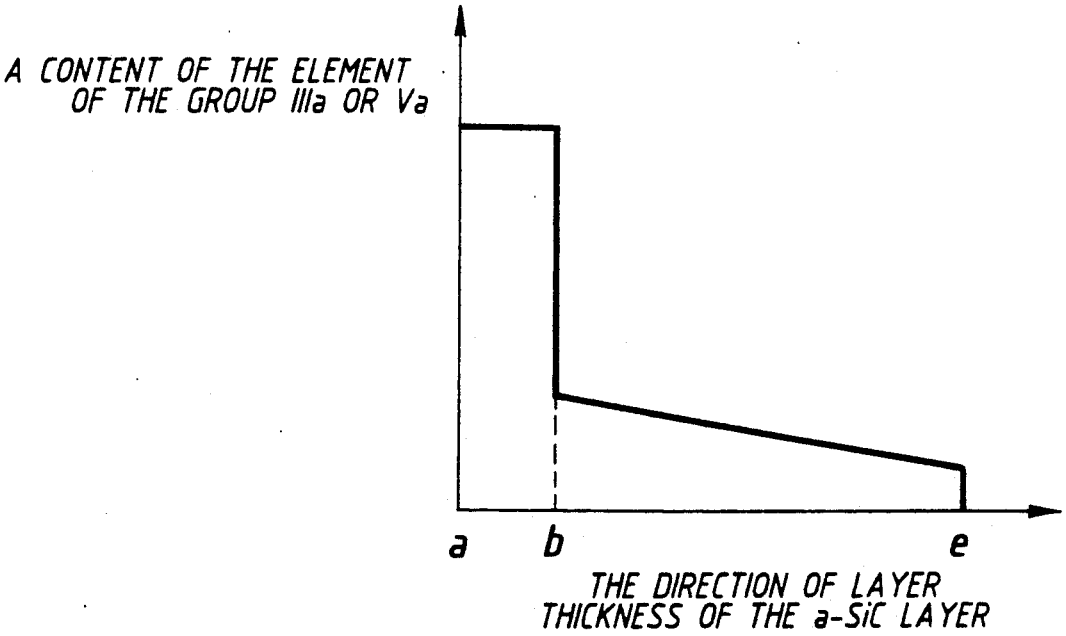
Figure 21:
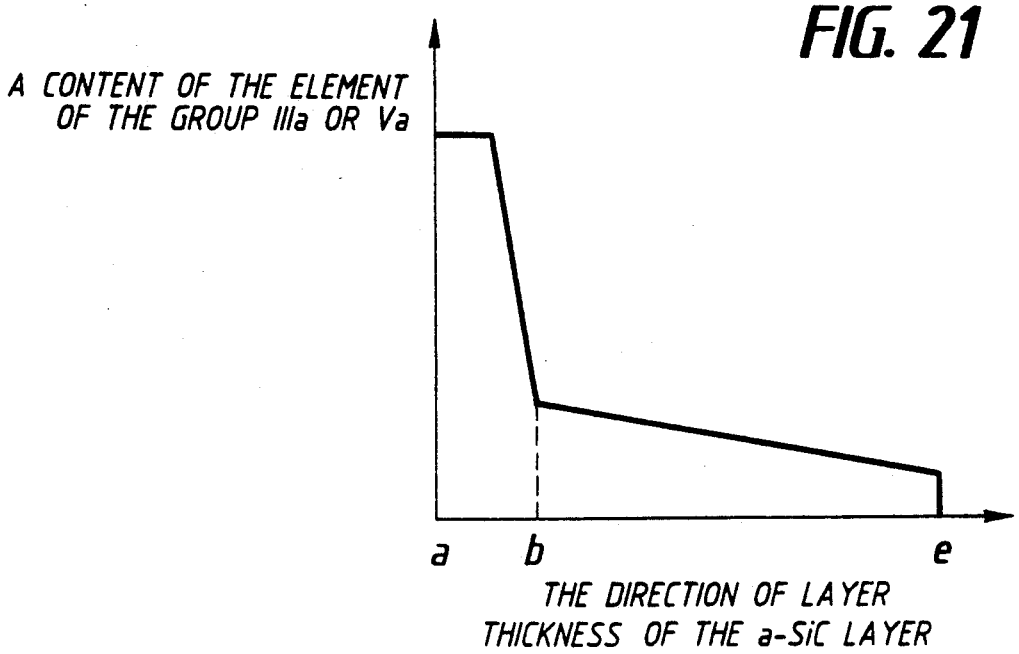

In addition, FIG. 2C shows an electrophotographic sensitive member according to the fifth invention and the sixth invention of the present invention. Referring to FIG. 2C, a photoconductive a-SiC layer (5) is formed on an electrically conductive substrate (1), said layer (5) comprising a first layer zone (5*a*), a second layer zone (5*b*), a third layer zone (5*c*) and a fourth layer zone (5*d*) corresponding to a content of the IIIa group elements or the Va group elements or carbon.

The electrophotographic sensitive member according to the fifth invention and the sixth invention is characterized by that, in the case where the IIIa group elements or the Va group elements are contained in the second layer zone (5*b*) in a quantity within the appointed range, it can be positively or negatively charged and improved in charge acceptance and photosensitivity, and the charge acceptance can be still further enhanced by forming the third layer zone (5*c*) and the fourth layer zone (5*d*) and the photosensitivity can be still further improved by containing oxygen in the second layer zone (5*b*) and/or the third layer zone (5*c*) in a quantity within the appointed range.

At first, it seems to be the reason why the a-SiC layer has the photoconductivity that the photoconductivity is generated by containing amorphous silicon and carbon as indispensable constituent elements and additionally a hydrogen element (H) and halogen elements in a quantity within the desired range to terminate their dangling bonds. The present inventors carried out the experiments aiming at the confirmation of the photoconductivity with variously changing a content ratio of carbon wit the results that carbon should be contained in the a-SiC layer (5) in a quantity of 1 to 90 atomic %, preferably 5 to 50 atomic %, or a carbon content may be changed in a direction of layer-thickness within said range.

In addition, the above described carbon-content is expressed by a ratio of a C element to the total sum of the Si element and the C element.

In addition, the hydrogen element (H) and the halogen elements should be contained in a quantity of 5 to 50 atomic %, preferably 5 to 40 atomic %, most suitably 10 to 30 atomic %. In general, a hydrogen element is used. Since this hydrogen element is easy to be incorporated into a terminating portion of the dangling bond, the density of the localized state in the band gap is reduced, whereby superior semiconductor characteristics can be obtained.

In addition, this hydrogen element may be partially replaced with halogen elements, whereby the density of the localized state of the a-SiC layer can be reduced to enhance the photosensitivity and the heat resistance (temperature characteristics). The replacement ratio should be 0.01 to 50 atomic %, preferably 1 to 3C atomic %, based on the total elements for terminating the dangling bonds. In addition, the halogen elements include F, Cl, Br, I, At and the like. Above all, if F is used, an interatomic bond is enhanced due to an increased electrical negativity of F, whereby the thermal stability is superior, which is desirable.

In addition, according to the first, third and fifth inventions, the content of the IIIa group elements in the second layer zone (5*b*) of the a-SiC layer (5) is set within a range of 0.1 to 10,000 ppm, preferably 0.1 to 1,000 ppm, whereby the desired electrophotographic characteristics, such as charge acceptance and photosensitivity, can be obtained. And, the formation of the first layer zone (5*a*) containing the IIIa group elements in a quantity larger than that in the layer zone (5*b*) leads to an increased conductivity in the range on the substrate side of the photoconductive a-SiC layer (5), whereby the injection of carriers from the substrate side is prevented and thus photocarriers, which have been generated in all over range of the a-SiC layer (5), are smoothly flown to the substrate. As a result, the charge acceptance and photosensitivity can be still more improved.

In addition, according to the second, fourth and sixth inventions, the content of the Va group elements in the second layer zone (5*b*) is suitably set within a range of 0 to 10,000 ppm, preferably 1 to 1,000 ppm, whereby the desired electropbotograpbic characteristics, such as charge acceptance and photosensitivity, can be obtained. And, the formation of the first layer zone (5*a*) containing the Va group elements in a quantity larger than that in the layer zone (5*b*) leads to an enhanced conductivity in a range on the substrate side of the photoconductive a-SiC layer (5), whereby the injection of carriers from the substrate side is prevented and thus photocarriers, which have been generated in all over range of the a-SiC layer (5), are smoothly flown to the substrate. As a result, the charge acceptance and photosensitivity can be still more improved.

The IIIa group elements or the Va group elements should be contained in the first layer zone (5*a*) in a quantity of 100 ppm or more, whereby the dark resistance is reduced and the carriers are effectively flown to the substrate side. As a result, the charge acceptance and photosensitivity can be most advantageously improved.

Positively or negatively charging the photosensitive member having the above described construction to compare the charge acceptance in both cases, it is positively charged in the case where the IIIa group elements are contained in the photoconductive a-SiC layer (5), negatively in the case where the Va group elements are contained in the photoconductive a-SiC layer, and negatively also in the case where the Va group elements are not contained in the photoconductive a-SiC layer (5), whereby the charge acceptance can be advantageously enhanced.

It seems to be the reason why the photosensitive member is easy to be positively or negatively charged by doping the IIIa group elements or the Va group elements that in the case where the a-SiC layer contains the IIIa group elements therein, the a-SiC layer has a high resistance sufficient for holding the positive charge, being superior in effect for preventing the injection of the negative charge from the substrate, being superior in charge-mobility of the positive charge, and the like while in the case where the a-SiC layer contains the Va group elements therein or does not contain them therein, the a-SiC layer has a high resistance sufficient for holding the negative charge, being superior in effect for preventing the injection of the positive charge from the substrate, being superior in charge-mobility of the negative charge, and the like.

The IIIa group elements include B, Al, Ga, In and the like but above all B is desired in view of the capability of sensitively changing the semiconductor characteristics thereof due to the superior covalent bond thereof.

In addition, the Va group elements include N, P, As, Sb and Bi but above all P is desirable in view of the capability of sensitively changing the semiconductor characteristics thereof due to the superior covalent bond thereof.

Carbon is contained in the third layer zone (5*c*) according to the above described third and fourth inventions in a quantity larger than that in the second layer zone (5*b*) to increase the dark resistance on the surface side of the photosensitive member, whereby remarkably improving the charge acceptance. It is preferable that the content of carbon in the third layer zone (5*c*) is set within a range of 10 to 90 atomic %, preferably 20 to 50 atomic %.

In addition, carbon is contained in the fourth layer zone (5*d*) according to the fifth and sixth inventions in a quantity larger than that in the third layer zone (5*c*) to still more increase the dark resistance on the surface side of the photosensitive member, whereby obtaining the photosensitive member having a high voltage resistance and a long useful life. It is preferable that the content of carbon in the fourth layer zone (5*d*) is set within a range of 20 to 90 atomic %, preferably 30 to 60 atomic %.

The first and second inventions of the present invention are characterized by that oxygen is contained in the above described second layer zone (5*b*) in a quantity of $5\times10^{-5}$ to 1 atomic %. In this case, the improvement of the characteristics can be expected all over the electrophotographic characteristics. The present inventors have found that in particular the photosensitive characteristics are remarkably influenced.

Also the third, fourth, fifth and sixth inventions are characterized by that oxygen is contained in the second layer zone (5*b*) and/or the third layer zone (5*c*) in the above described layer structure in a quantity $5\times10^{-5}$ to 1 atomic %. In this case, the improvement of the characteristics can be expected all over the electrophotographic characteristics. The present inventors have found that in particular the photosensitive characteristics are remarkably affected.

That is to say, in the case where oxygen is contained in the second and third layer zones (5*b*), (5*c*) in a quantity of $5\times10^{-5}$ to 1 atomic %, preferably $5\times10^{-5}$ to 0.1 atomic %, most preferably $5\times10^{-4}$ to 0.1 atomic %, the photosensitivity is whereby an instrument carrying this photosensitive member thereon can be applied to the still wider uses. It is a matter of course that the problems, which have been brought about with the reduction of photosensitivity, that is, the background smearing of the image and the increased residual potential, can be solved.

Although such the solution has not been sufficiently made clear yet by the present inventors, it seems that oxygen serves as the above described dangling bond-terminating element.

In order to contain oxygen in the second and third layer zones (5*b*), (5*c*), and oxygen gas ($O_2$) or oxygen element-containing gases, such as CO, $CO_2$, NO, $N_2O$ and $NO_2$, are contained in raw material gases used in various kinds of thin film-forming means. If oxygen is contained in the film in a quantity within the above described range, oxygen may be unavoidably contained as impurities.

A thickness of the above described photoconductive a-SiC layer (5) should be at least 5 μm, whereby the charge acceptance amounts to 200 V or more. In addition, an upper limit of the thickness of the photoconductive a-SiC layer (5) is suitably selected within a range where the resolution of image and the flow of image are not brought about. According to the experiments by the present inventors, it is preferable to set it within a range of 5 to 100 μm, preferably 10 to 50 μm.

In addition, a thickness of the first layer zone (5*a*) is set within a range of 0.05 to 10 μm, preferably 0.1 to 5 μm. If it is within such the range, the residual potential can be advantageously reduced. On the other hand, a thickness of the second layer zone (5*b*) is set within a range of 5 to 100 μm, preferably 10 to 50 μm. If it is within such the range, the charge acceptance and the photosensitivity can be remarkably improved.

A thickness of the third layer zone (5*c*) is set at a value equal to that of the second layer zone (5*b*) or less, preferably ½ times that of the second layer zone (5*b*) or less, most preferably ¼ times that of the second layer zone (5*b*) or less. In the case where the thickness is set at such the value, the charge acceptance is remarkably improved, the photosensitivity being enhanced, and the residual potential being reduced.

In addition, a thickness of the fourth layer zone (5*d*) is set within a range of 0.1 to 5 μm, preferably 0.5 to 3 μm. In this case, the photosensitive member having a reduced residual potential, an improved charge acceptance, a high voltage resistance and a long useful life can be obtained.

Thus, according to the electrophotographic sensitive member of the present invention, the electrophotographic characteristics, such as charge acceptance and photosensitivity, can be improved by composing it substantially of a photoconductive a-SiC layer and containing the IIIa group elements or the Va group elements, carbon and oxygen in said a-SiC layer in a quantity within the appointed ranges.

In the first and second inventions of the present invention the carbon-content of the a-SiC layer (5) may be changed in the direction of layer-thickness, as shown in for example FIGS. 3 to 7.

In addition, in the third and fourth inventions of the present invention the carbon-content of the a-SiC layer (5) may be changed in the direction of layer-thickness, as shown in FIGS. 8 to 13.

In addition, in the fifth and sixth inventions the carbon-content of the a-SiC layer (5) may be changed in the direction of layer-thickness, as shown in FIGS. 14 to 17.

Referring to these drawings, an axis of abscissa designates the direction of layer-thickness of the a-SiC layer (5), a designating a boundary surface between the a-SiC layer (5) and the substrate (1), b designating a boundary surface between the first layer zone (5*a*) and the second layer zone (5*b*), c designating a boundary surface between the second layer zone (5*b*) and the third layer zone (5*c*), d designating a boundary surface between the third layer zone and the fourth layer zone (5*d*), e designating a surface of the photosensitive member, and an axis of ordinate designating a carbon-content.

Or, the content of the IIIa group elements or the Va group elements of the a-SiC layer (5) may be changed in the direction of layer-thickness of the first layer zone (5*a*) and the second layer zone (5*b*), as shown in FIGS. 18 to 21.

In addition, according to the present invention, the conventionally known surface protective layer may be formed on the a-SiC layer (5). Various kinds of material having high insulating property, high corrosion resistance and high hardness can be used for forming the surface protective layer. For example, organic materials, such as polyimide resin, and inorganic materials, such as a-SiC, $SiO_2$, SiO, $Al_2O_3$, SiC, $Si_3N_4$, a-Si, a-Si:H, a-Si:F, a-SiC:H and a-SiC:F, can be used.

In addition, the conventionally known barrier layer may be formed between the substrate (1) and the a-SiC layer (5) and the same materials as in the above described protective layer can be used for this layer.

Next, the method of producing the electrophotographic member according to the present invention is described.

The a-SiC layer according to the present invention can be formed by the thin-film forming techniques, such as glow discharge decomposition method, ion plating method, reactive sputtering method, vacuum deposition method and CVD method, and solid, liquid and gaseous materials may be used as the materials of the a-SiC layer. The gaseous materials used in the glow discharge decomposition method include for example silicon series of gases, such as $SiH_4$, $Si_2H_6$ and $Si_3H_8$, and carbon series of gases, such as $CH_4$, $C_2H_2$, $C_2H_4$, $C_2H_6$ and $C_3H_8$, and a He gas, $H_2$ gas and the like may be used as the carrier gas.

In the case where the electrophotographic sensitive member according to the present invention is produced by the glow discharge decomposition method, if a mixture gas comprising Si element series of gas and an acethylene gas ($C_2H_2$) is used for the formation of the a-SiC layer, the film-forming speed can be remarkably increased, which is desirable. According to the experiments repeated by the present inventors, in the case where the $SiH_4$ gas and the $C_2H_2$ gas were used, the film-forming speed amounted to 5 to 20 μm/hour. Incidentally, in the case where the a-SiC layer is formed using the $SiH_4$ gas and the $CH_4$ gas, the film-forming speed amounts to about 0.3 to 1 μm/hour.

Next, the capacitively couple type glow discharge decomposition apparatus used in the referred embodiments of the present invention is described with reference to FIG. 22.

Figure 22:
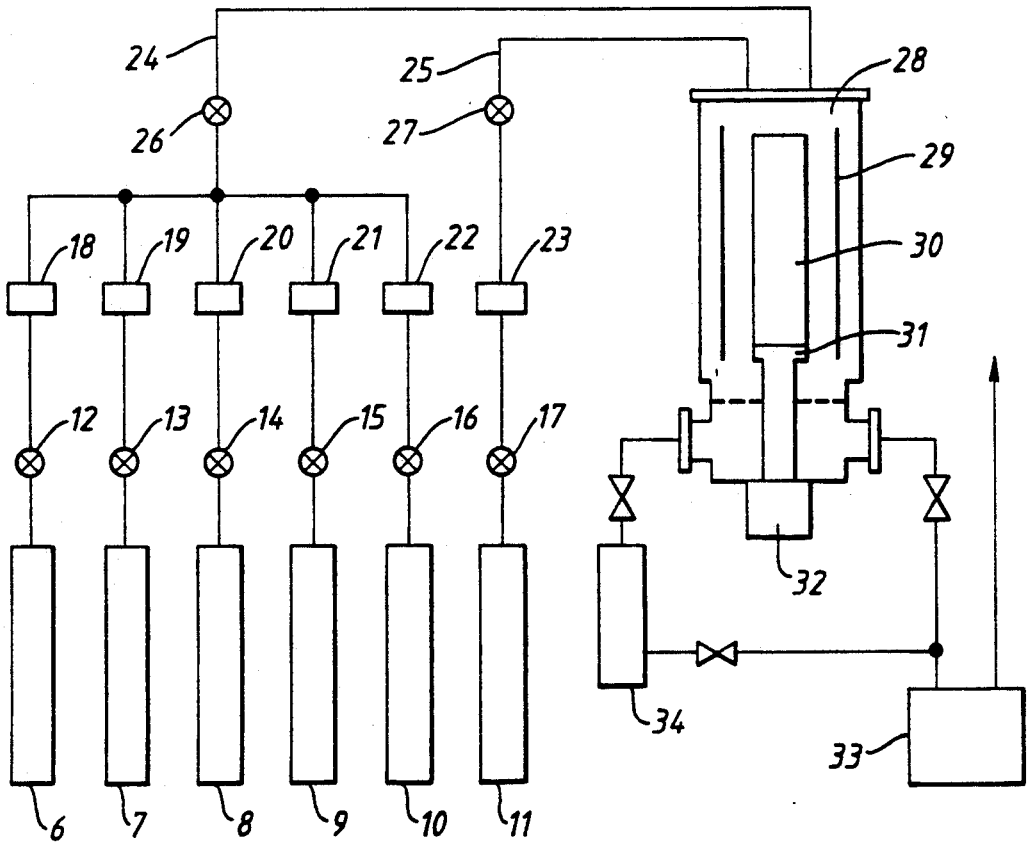
FIG. 22 is a diagram showing a capacitively couple type glow discharge decomposition apparatus used in the preferred embodiments.

Referring to FIG. 22, the first, second, third, fourth, fifth and sixth tanks (6), (7), (8), (9), (10), (11) are filled with $SiH_4$, $C_2H_2$, $PH_3$ or $B_2H_6$ (every gas is diluted with a $H_2$ gas until a concentration of 0.2%), $PH_3$ or $B_2H_6$ ($PH_3$ is diluted with a $H_2$ gas until a concentration of 33 ppm and $B_2H_6$ until a concentration of 38 ppm), $H_2$ gas and NO gas, respectively, and $H_2$ is used also as the carrier gas. These gases are released by opening the corresponding first, second, third, fourth, fifth and sixth regulating valves (12), (13), (14), (15), (16), and (17) and their flow rates are y mass flow controllers (18), (19), (20), (21), (22), (23). The gases from the first, second, third, fourth and fifth tanks (6), (7), (8), (9), (10) are sent to a first main pipe (24) and the NO gas from the sixth tank (11) is sent to a second main pipe (25). In addition, reference numerals (26), (27) designate stop valves. The gases passing through the first main pipe (24) and the second main pipe (25) are sent to a reaction tube (28) and a capacitively couple type discharge electrode (29) is disposed within the reaction tube (28). A high-frequency electric power applied to the capacitively couple type discharge electrode (29) is suitably 50 W to 3 KW and a wavelength 1 MHz to 50 MHz. A cylindrical film-forming substrate (30) made of aluminum is placed on a sample holder (31) within the reaction tube (28), said sample holder (31) being rotated by means of a motor (32), and the substrate (30) being uniformly heated at temperatures of about 200 to 400° C., preferably about 200 to 350° C., by means of suitable heating means. In addition, it is necessary to highly evacuate (a gas pressure during the discharge is 0.1 to 2.0 Torr) an inside of the reaction tube (28) during the formation of the a-SiC film, so that the reaction tube (28) is connected with a rotary pump (33) and a diffusion pump (34).

With the glow discharge decomposition apparatus having the above described construction, in the case where for example an a-SiC layer (containing oxygen, P or B) is formed on the substrate (30), the first, second, third and fifth regulating valves (12), (13), (14), (16) are opened to release the $SiH_4$ gas, $C_2H_2$ gas, $PH_3$ gas or $B_2H_6$ gas and $H_2$ gas and the sixth regulating valve (17) is opened to release the NO gas. The quantities of the gases released are controlled by means of the mass flow controllers (18), (19), (20), (22), (23). The gaseous mixture comprising $SiH_4$. $C_2H_2$, $PH_3$ or $B_2H_6$ and $H_2$ is flown into the reaction tube (28) through the first main pipe (24) while the NO gas is flown into the reaction tube (28) through the second main pipe (25). And, the glow discharge is brought about by evacuating the inside of the reaction tube (28) until about 0.1 to 2.0 Torr, heating the substrate until the temperatures of 200 to 400° C. setting the high-frequency electric power of the capacitively couple type discharge electrode (29) at 50 W to 3 KW, and setting the frequency at 1 to 50 MHz to decompose the gases, whereby forming the a-SiC layer containing oxygen and P or B on the substrate at high speed.

The present invention will be below described in more detail with reference to the EXAMPLES.

EXAMPLE 1

A photoconductive a-SiC layer was formed on the aluminum substrate (30) under the conditions shown in Tables 1, 2 to measure electrophotographic characteristics thereof. However, the NO gas was introduced during the formation of the first layer zone (5a) to contain oxygen and nitrogen in this layer zone (5a) whereby enhancing an adhesion of the photoconductive a-SiC layer to the substrate (30).

A numerical value in a parenthesis for $PH_3$ in Table 1 and a numerical value in a parenthesis for B in Table 2 shows a concentration of the $PH_3$ gas and the $B_2H_6$ gas diluted with the $H_2$ gas, respectively.

In addition, this is similar also to Table 3 and thereafter which are mentioned later.

TABLE 1

| | Gas flow rate (sccm) | | | | | Gas Pressure | RF electric | Film-forming | Thickness |
|---|---|---|---|---|---|---|---|---|---|
| | $SiH_4$ | $C_2H_2$ | $H_2$ | $PH_3$ (0.2%) | NO | (Torr) | power (W) | time (min) | (μm) |
| Second layer zone | 150 | 10 | 100 | — | 0.1 | 0.45 | 180 | 240 | 25 |
| First layer zone | 150 | 10 | 100 | 70 | 2.5 | 0.45 | 180 | 90 | 4.5 |

TABLE 2

| | Gas flow rate (sccm) | | | | | | Gas Pressure | RF electric | Film-forming | Thickness |
|---|---|---|---|---|---|---|---|---|---|---|
| | $SiH_4$ | $C_2H_2$ | $H_2$ | $B_2H_6$ (38 ppm) | $B_2H_6$ (0.2%) | NO | (Torr) | power (W) | time (min) | (μm) |
| Second layer zone | 150 | 10 | 100 | 90 | — | 0.1 | 0.45 | 180 | 250 | 26 |
| First layer zone | 150 | 10 | 100 | — | 70 | 2.5 | 0.45 | 100 | 60 | 3.0 |

The charge acceptance, the photosensitivity and the residual potential were measured as the electrophotographic characteristics with the following results. These results were obtained by charging the photosensitive member obtained under the conditions shown in Table 1 by means of a corona charger of −5.6 KV and the photosensitive member obtained under the conditions shown in Table 2 by means of a corona charger of +5.6 KV and then irradiating the surface of the photosensitive member with a spectralized monochromatic light (650 nm).

| | Photosensitive member produced under the conditions shown in Table 1 | Photosensitive member produced under the conditions shown in Table 2 |
|---|---|---|
| Charge acceptance | −750 V | +780 V |
| Photosensitivity | 0.60 $cm^2erg^{-1}$ | 0.45 $cm^2erg^{-1}$ |
| Residual potential (value after 5 seconds from the start of exposure) | 30 V | 35 V |

In addition, carbon-contents (content-ratio of the carbon element based on the total sum content of the Si element and the C element) of the first layer zone and the second layer zone were determined by the XMA analysis and the P-content (B-content for the photosensitive member produced under the conditions shown in Table 2) and the oxygen-content of the respective layer zones were determined by the secondary ion mass spectroscopy with the following results.

| | Photosensitive member produced under the conditions shown in Table 1 | Photosensitive member produced under the conditions shown in Table 2 |
|---|---|---|
| First layer zone | | |
| Carbon-content | 23 atomic % | 23 atomic % |
| P-content | 900 ppm | — |
| B-content | — | 1,100 ppm |
| Oxygen-content | 0.5 atomic % | 0.5 atomic % |
| Second layer zone | | |
| Carbon-content | 18 atomic % | 18 atomic % |
| B-content | — | 200 ppm |
| Oxygen-content | $5 \times 10^{-2}$ atomic % | $5 \times 10^{-2}$ atomic % |

EXAMPLE 2

An electrophotographic sensitive member was produced under the conditions shown in Table 3. And, the electrophotographic characteristics were measured with the following results.

Charge acceptance—770 V
Photosensitivity—0.67 $cm^2erg^{-1}$
Residual Potential—30 V

TABLE 3

| | Gas flow rate (sccm) | | | | | | Gas Pressure | RF electric | Film-forming | Thickness |
|---|---|---|---|---|---|---|---|---|---|---|
| | $SiH_4$ | $C_2H_2$ | $H_2$ | $PH_3$ (33 ppm) | $PH_3$ (0.2%) | NO | (Torr) | power (W) | time (min) | (μm) |
| Second layer zone | 150 | 10 | 0 | 100 | — | 0.1 | 0.45 | 180 | 240 | 25 |
| First layer zone | 150 | 10 | 100 | — | 70 | 2.5 | 0.45 | 100 | 90 | 4.5 |

In addition, the carbon-content, the P-content and the oxygen-content of the first layer zone and the second layer zone were measured with the following results.

First layer zone

Carbon-content—23 atomic %
P-cotent—900 ppm
Oxygen-content—0.5 atomic %

Second layer zone

Carbon-content—18 atomic %
P-content—15 ppm
Oxygen-content—$5\times10^{-2}$ atomic %

EXAMPLE 3

An electrophotographic sensitive member was produced in the same manner as in EXAMPLE 2 excepting that a tank filled with an $O_2$ gas in place of a NO gas was used as the sixth tank (11) and the conditions shown in Table 4 were adopted. And, the electrophotographic characteristics of the resulting photosensitive member were as follows:

Charge acceptance—770 V
Photosensitivity—0.58 $cm^2$ $erg^{-1}$
Residual potential—33 V

TABLE 4

| | Gas flow rate (sccm) | | | | | | Gas Pressure | RF electric | Film-forming | Thickness |
|---|---|---|---|---|---|---|---|---|---|---|
| | $SiH_4$ | $C_2H_2$ | $H_2$ | $PH_3$ (33 ppm) | $PH_3$ (0.2%) | $O_2$ | (Torr) | power (W) | time (min) | (μm) |
| Second layer zone | 150 | 10 | 100 | 33 | — | 0.1 | 0.45 | 180 | 240 | 25 |
| First layer zone | 150 | 10 | 100 | — | 70 | 1.0 | 0.45 | 100 | 90 | 4.5 |

In addition, the carbon-content, the P-content and the oxygen-content of the respective layer zones were measured with the following results:

First layer zone

Carbon-content—23 atomic %

P-content—900 ppm
Oxygen-content—0.8 atomic %

Second layer zone

Carbon-content—18 atomic %
P-content—15 ppm
Oxygen-content—$8\times10^{-2}$ atomic %

EXAMPLE 4

An electrophotographic sensitive member was produced in the same manner as in EXAMPLE 1 excepting that a tank filled with an $O_2$ gas in place of a NO gas was used as the sixth tank (11) and the conditions shown in Table 5 were adopted. And, the electrophotographic characteristics of the resulting photosensitive member were as follows:

Charge acceptance—+790 V
Photosensitivity—0.43 $cm^2$ $erg^{-1}$
Residual potential—38 V

TABLE 5

| | Gas flow rate (sccm) | | | | | | Gas Pressure | RF electric | Film-forming | Thickness |
|---|---|---|---|---|---|---|---|---|---|---|
| | $SiH_4$ | $C_2H_2$ | $H_2$ | $B_2H_6$ (38 ppm) | $B_2H_6$ (0.2%) | $O_2$ | (Torr) | power (W) | time (min) | (μm) |
| Second layer zone | 150 | 10 | 100 | 90 | — | 0.1 | 0.45 | 180 | 250 | 26 |
| First layer zone | 150 | 10 | 100 | — | 70 | 1.0 | 0.45 | 100 | 60 | 3.0 |

In addition, the carbon-content, the B-content and the oxygen-content of the respective layer zones were measured with the following results:

First layer zone

Carbon-content—23 atomic %
B-content—1,100 ppm
Oxygen-content—0.8 atomic %

Second layer zone

Carbon-content—18 atomic %
B-content—200 ppm
Oxygen-content—$8\times10^{-2}$ atomic %

EXAMPLE 5

Various kinds of photosensitive member were produced in the same manner as in EXAMPLE 3 excepting that the oxygen-content, the P-content and the carbon-content of the second layer zone were changed. The resulting photosensitive members were evaluated on image quality with the results as shown in Table 6.

Referring to Table 6, the evaluation of image quality is classified into three ranks, that is, ⊙ marks express the case where the image concentration is high, the photosensitivity being high, and no background smearing being produced at all, ○ marks expressing the case where the photosensitivity and the image concentration are inferior to ∘ marks and the background smearing is produced to some extent but no practical hindrance is brought about, and x marks expressing the case where the photosensitivity, the image concentration and the background smearing are all inferior.

In addition, the kinds of the photosensitive members in Table 6 marked with * are outside of the scope of the present invention.

TABLE 6

| Kind of photosensitive member | Oxygen-content (atomic %) | P-content (ppm) | Carbon-content (atomic %) | Evaluation of image quality |
|---|---|---|---|---|
| 1* | $1\times10^{-5}$ | 15 | 18 | X |
| 2 | $1\times10^{-4}$ | 15 | 27 | ○ |
| 3 | $5\times10^{-3}$ | 15 | 18 | ⊙ |
| 4 | $5\times10^{-2}$ | 15 | 10 | ⊙ |
| 5 | 0.5 | 15 | 10 | ○ |
| 6* | 2.0 | 15 | 18 | X |
| 7* | $5\times10^{-2}$ | 1200 | 18 | X |
| 8 | $5\times10^{-2}$ | 1.0 | 18 | ⊙ |
| 9 | $5\times10^{-2}$ | 4.0 | 27 | ⊙ |
| 10 | 0.5 | 60 | 27 | ○ |
| 11 | 0.5 | 150 | 55 | ○ |
| 12 | 0.5 | 400 | 55 | ○ |

As obvious from Table 6, the photosensitive members 2 to 5 and 8 to 12 according to the present invention exhibited the superior photosensitivity and image concentration and the remarkably reduced or no background smearing.

However, the photosensitive member 1 exhibited the reduced oxygen-content, the photosensitive member 6 exhibiting the increased oxygen-content, and the photosensitive member 7 exhibiting the P-content of the second layer zone larger than that of the first layer zone. Accordingly, every photosensitive member exhibited the reduced image concentration, the inferior photosensitivity and the background smearing.

EXAMPLE 6

Various kinds of photosensitive member were produced in the same manner as in EXAMPLE 4 excepting that the oxygen-content, the B-content and the carbon-content of the second layer zone were changed. The resulting photosensitive members were evaluated on image quality with the results as shown in Table 7.

The evaluation of image quality is similar to that in Table 6.

TABLE 7

| Kind of photosensitive member | Oxygen-content (atomic %) | B-content (ppm) | Carbon content (atomic %) | Evaluation of image quality |
|---|---|---|---|---|
| 13* | $1\times10^{-5}$ | 20 | 18 | X |
| 14 | $1\times10^{-4}$ | 20 | 27 | ○ |
| 15 | $8\times10^{-3}$ | 20 | 18 | ⊙ |
| 16 | $8\times10^{-2}$ | 20 | 10 | ⊙ |
| 17 | 0.7 | 20 | 10 | ○ |
| 18* | 2.0 | 20 | 18 | X |
| 19* | $8\times10^{-2}$ | 1200 | 18 | X |
| 20 | $8\times10^{-2}$ | 1.0 | 18 | ⊙ |
| 21 | $8\times10^{-2}$ | 5.0 | 27 | ⊙ |
| 22 | 0.7 | 70 | 27 | ○ |
| 23 | 0.7 | 180 | 55 | ○ |
| 24 | 0.7 | 500 | 55 | ○ |

As obvious from Table 7, the photosensitive members 14 to 17 and 20 to 24 exhibited the superior photosensitivity and image concentration and the remarkably reduced or no background smearing.

However, the photosensitive member 13 exhibited the reduced oxygen-content, the photosensitive member 18 exhibiting the increased oxygen-content, and the photosensitive member 19 exhibiting the B-content of the second layer zone larger than that of the first layer zone. Accordingly, every photosensitive member exhibited the reduced image concentration, the inferior photosensitivity and the background smearing.

EXAMPLE 7

Photoconductive a-SiC layers were formed on an aluminum substrate (30) under the conditions shown in Tables 8, 9 and the electrophotographic characteristics thereof were measured. However, the NO gas was introduced during the time when the first layer zone (5*a*) was formed to contain oxygen and nitrogen in this layer zone (5*a*) to enhance the adhesion of the photoconductive a-SiC layer to the substrate (30).

TABLE 8

| | Gas flow rate (sccm) | | | | | | Gas Pressure | RF electric | Film-forming | Thickness |
|---|---|---|---|---|---|---|---|---|---|---|
| | $SiH_4$ | $C_2H_2$ | $H_2$ | $PH_3$ (33 ppm) | $PH_3$ (0.2%) | NO | (Torr) | power (W) | time (min) | (μm) |
| Third layer zone | 150 | 20 | 100 | — | — | 0.1 | 0.5 | 180 | 25 | 4 |
| Second layer zone | 150 | 10 | 100 | 100 | — | 0.1 | 0.45 | 180 | 190 | 21 |
| First layer zone | 150 | 10 | 100 | — | 70 | 2.5 | 0.45 | 100 | 90 | 4.5 |

TABLE 9

| | Gas flow rate (SCCM) | | | | | | Gas | RF electric | Film-forming | |
|---|---|---|---|---|---|---|---|---|---|---|
| | $SiH_4$ | $C_2H_2$ | $H_2$ | $B_2H_6$ (38 ppm) | $B_2H_6$ (0.2%) | NO | Pressure (Torr) | power (W) | time (min) | Thickness (μm) |
| Third layer zone | 150 | 20 | 100 | — | — | 0.1 | 0.5 | 180 | 23 | 3.7 |
| Second layer zone | 150 | 10 | — | 90 | — | 0.1 | 0.45 | 180 | 215 | 24 |
| First layer zone | 150 | 10 | 100 | — | 70 | 2.5 | 0.45 | 100 | 60 | 3 |

The electrophotographic characteristics, such as charge acceptance, photosensitivity and residual potential, were measured with the following results. The photosensitive member produced under the conditions shown in Table 8 was charged by a corona charger of −5.6 KV and the photosensitive member produced under the conditions shown in Table 9 was charged by a corona charger of +5.6 KV and then irradiated the surface thereof with a spectralized monochromatic light (650 nm).

| | Photosensitive member produced under the conditions shown in Table 8 | Photosensitive member produced under the conditions shown in Table 9 |
|---|---|---|
| Charge acceptance | −800 V | +850 V |
| Photosensitivity | 0.68 $cm^2erg^{-1}$ | 0.44 $cm^2erg^{-1}$ |
| Residual potential (value after 5 seconds from the start of exposure) | 25 V | 40 V |

-continued

In addition, carbon-contents (content-ratio of the carbon element based on the total sum content of the Si element and the C element) of the first layer zone, the second layer zone and the third layer zone were determined by the XMA analysis and the P-content (B-content for the photosensitive member produced under the conditions shown in Table 9) and the oxygen-content of the respective layer zones were determined by the secondary ion mass spectroscopy with the following results.

| | Photosensitive member produced under the conditions shown in Table 8 | Photosensitive member produced under the conditons shown in Table 9 |
|---|---|---|
| First layer zone | | |
| Carbon-content | 23 atomic % | 23 atomic % |
| P-content | 900 ppm | — |
| B-content | — | 1,100 ppm |
| Oxygen-content | 0.5 atomic % | 0.5 atomic % |
| Second layer zone | | |
| Carbon-content | 18 atomic % | 18 atomic % |
| P-content | 15 ppm | — |
| B-content | — | 20 ppm |
| Oxygen-content | $5 \times 10^{-2}$ atomic % | $5 \times 10^{-2}$ atomic % |
| Third layer zone | | |
| Carbon-content | 34 atomic % | 34 atomic % |
| Oxygen-content | $5 \times 10^{-2}$ atomic % | $5 \times 10^{-2}$ atomic % |

EXAMPLE 8

An electrophotographic sensitive member was produced under the same conditions as shown in Table 8 in EXAMPLE 7 excepting that a tank filled with an $O_2$ gas in place of a NO gas was used as the sixth tank (11) and the conditions shown in Table 10 were adopted. And, electrophotographic characteristics of the resulting photosensitive member were as follows:

Charge acceptance——830 V
Photosensitivity—0.65 $cm^2 erg^{-1}$
Residual potential—30 V

TABLE 10

| | Gas flow rate (SCCM) | | | | | | Gas Pressure (Torr) | RF electric power (W) | Film-forming time (min) | Thickness (μm) |
|---|---|---|---|---|---|---|---|---|---|---|
| | $SiH_4$ | $C_2H_2$ | $H_2$ | $PH_3$ (33 ppm) | $PH_3$ (0.2%) | $O_2$ | | | | |
| Third layer zone | 150 | 20 | 100 | — | — | 0.1 | 0.5 | 180 | 25 | 4 |
| Second layer zone | 150 | 10 | 0 | 100 | — | 0.1 | 0.45 | 180 | 190 | 21 |
| First layer zone | 150 | 10 | 100 | — | 70 | 1.0 | 0.45 | 100 | 90 | 4.5 |

In addition, the carbon-content, the P-content and the oxygen-content of the respective layer zones were determined with the following results:

| | |
|---|---|
| First layer zone | |
| Carbon-content | 23 atomic % |
| P-content | 90 ppm |
| Oxygen-content | 0.8 atomic % |
| Second layer zone | |
| Carbon-content | 18 atomic % |
| P-content | 15 ppm |
| Oxygen-content | $8 \times 10^{-2}$ atomic % |
| Third layer zone | |
| Carbon-content | 34 atomic % |
| Oxygen-c nrtnt | $8 \times 10^{-2}$ atomic % |

EXAMPLE 9

An electrophotographic sensitive member was produced under the same conditions as shown in Table 9 in EXAMPLE 7 excepting that a tank filled with an $O_2$ gas in place of a NO gas was used as the sixth tank (11) and the conditions shown in Table 11 were adopted. Electrophotographic characteristics of the resulting photosensitive member were as follows:

Charge acceptance——+820 V
Photosensitivity—0.48 $cm^2 erg^{-1}$
Residual potential—35 V

TABLE 11

| | Gas flow rate (SCCM) | | | | | | Gas Pressure (Torr) | RF electric power (W) | Film-forming time (min) | Thickness (μm) |
|---|---|---|---|---|---|---|---|---|---|---|
| | $SiH_4$ | $C_2H_2$ | $H_2$ | $B_2H_6$ (38 ppm) | $B_2H_6$ (0.2%) | $O_2$ | | | | |
| Third layer zone | 150 | 20 | 100 | — | — | 0.1 | 0.5 | 180 | 23 | 3.7 |
| Second layer zone | 150 | 10 | 100 | 90 | — | 0.1 | 0.45 | 180 | 250 | 26 |
| First layer zone | 150 | 10 | 100 | — | 70 | 1.0 | 0.45 | 100 | 60 | 3.0 |

In addition, the carbon-content, the B-content and the oxygen-content of the respective layer zones were determined with the following results:

| | |
|---|---|
| First layer zone | |
| Carbon-content | 23 atomic % |
| B-content | 1,100 ppm |
| Oxygen-content | 0.8 atomic % |
| Second layer zone | |
| Carbon-content | 18 atomic % |
| B-content | 20 ppm |
| Oxygen-content | $8 \times 10^{-2}$ atomic % |
| Third layer zone | |
| Carbon-content | 34 atomic % |
| Oxygen-content | $8 \times 10^{-2}$ atomic % |

EXAMPLE 10

Various kinds of photosensitive member were produced in the same manner as in EXAMPLE 8 excepting that the P-content and the oxygen-content of the second layer zone and the oxygen-content of the third layer zone were changed. The image quality of the resulting various kinds of photosensitive member was evaluated with the results as shown in Table 12.

Referring to Table 12, the evaluation of image quality is classified into four ranks, that is, ⊚ marks express the case where the image concentration is high, the photosensitivity being high, and no background smearing being produced, ○ marks expressing the case where the photosensitivity and the image concentration are inferior to marks and the background smearing is produced to some extent but no practical hindrance is brought about, Δ marks expressing the case where the image concentration is obtained but the background smearing is produced to some extent, whereby the practical hindrance is brought about, and x marks expressing the case where the photosensitivity, the image concentration and the background smearing are all inferior.

TABLE 12

| Kind of photo-sensitive member | P-content of the second layer zone (ppm) | Oxygen-content of the second layer zone (atomic %) | Oxygen-content of the third layer zone (atomic %) | Evaluation of image quality |
|---|---|---|---|---|
| 25* | 0 | 0 | $2 \times 10^{-3}$ | Δ |
| 26* | 0 | $2 \times 10^{-5}$ | 0 | Δ |
| 27 | 0 | $1 \times 10^{-4}$ | 0 | ○ |
| 28 | 0 | 0 | $1 \times 10^{-4}$ | ○ |
| 29 | 15 | $3 \times 10^{-3}$ | $3 \times 10^{-3}$ | ◎ |
| 30 | 40 | $1 \times 10^{-2}$ | 0 | ◎ |
| 31 | 75 | $5 \times 10^{-2}$ | $5 \times 10^{-2}$ | ◎ |
| 32 | 200 | 0.5 | $5 \times 10^{-2}$ | ○ |
| 33 | 1200 | 0.8 | 0.2 | ○ |
| 34* | 15000 | 0.8 | $5 \times 10^{-2}$ | X |
| 35* | 200 | 2.0 | 0.3 | X |
| 36* | 40 | $5 \times 10^{-2}$ | 2.0 | X |

As obvious from Table 12, the photosensitive members 27 to 33 according to the present invention exhibited the superior photosensitivity and image concentration and the remarkably reduced or no background smearing.

However, the photosensitive members 25, 26 exhibited the reduced oxygen-content to produce the background smearing in the image. In addition, the photosensitive member 34 exhibited the increased P-content and the photosensitive members 35, 36 exhibited the increased oxygen-content and all photosensitive member exhibited the reduced image concentration, the inferior photosensitivity and the background smearing in the image.

EXAMPLE 11

Various kinds of photosensitive member were produced in the same manner as in EXAMPLE 9 excepting that the B-content and the oxygen-content of the second layer zone and the oxygen-content of the third layer zone were changed. The image quality of the resulting various kinds of photosensitive member was evaluated with the results as shown in Table 13.

In addition, the evaluation of image quality in Table 13 is similar to that in Table 12.

TABLE 13

| Kind of photo-sensitive member | B-content of the second layer zone (ppm) | Oxygen-content of the second layer zone (atomic %) | Oxygen-content of the third layer zone (atomic %) | Evaluation of image quality |
|---|---|---|---|---|
| 37* | 3 | 0 | $3 \times 10^{-5}$ | Δ |
| 38* | 3 | $3 \times 10^{-5}$ | 0 | Δ |
| 39 | 3 | $1 \times 10^{-4}$ | 0 | ○ |
| 40 | 3 | 0 | $2 \times 10^{-4}$ | ○ |
| 41 | 20 | $4 \times 10^{-3}$ | $4 \times 10^{-3}$ | ◎ |
| 42 | 50 | $1 \times 10^{-2}$ | 0 | ◎ |
| 43 | 80 | $5 \times 10^{-2}$ | $5 \times 10^{-2}$ | ◎ |
| 44 | 180 | 0.5 | $5 \times 10^{-2}$ | ○ |
| 45 | 1200 | 0.7 | 0.3 | ○ |
| 46* | 17000 | 0.7 | $5 \times 10^{-2}$ | X |
| 47* | 180 | 2.5 | 0.5 | X |
| 48* | 40 | $5 \times 10^{-2}$ | 2.5 | X |

As obvious from Table 13, the photosensitive member 39 to 45 according to the present invention exhibited the superior photosensitivity and image concentration and the remarkably reduced or no background smearing.

However, the photosensitive members 37, 38 exhibited the reduced oxygen-content to produce the background smearing in the image. In addition, the photosensitive member 46 exhibited the increased B-content and the photosensitive members 47, 48 exhibited the increased oxygen-content and all exhibited the reduced image concentration, the inferior Photosensitivity and the background smearing in the image.

EXAMPLE 12

A photoconductive a-SiC layer was formed on the aluminum substrate (30) under the conditions shown Tables 14, 15 and electrophotographic characteristics of the resulting photosensitive members were measured. However, when the first layer zone (5*a*) is formed, a NO gas is introduced to contain oxygen and nitrogen in the first layer zone (5*a*), whereby enhancing the adhesion of the film to the substrate (30).

TABLE 14

| | Gas flow rate (SCCM) | | | | | | Gas pressure (Torr) | RF electric power (W) | Film-forming time (min) | Thickness (μm) |
|---|---|---|---|---|---|---|---|---|---|---|
| | $SiH_4$ | $C_2H_2$ | $H_2$ | $PH_3$ (38 ppm) | $PH_3$ (0.2%) | NO | | | | |
| Fourth layer zone | 150 | 35 | — | — | — | 0.1 | 0.4 | 150 | 5 | 1 |
| Third layer zone | 150 | 20 | 100 | — | — | 0.1 | 0.5 | 180 | 20 | 3 |
| Second layer zone | 150 | 10 | 10 | 100 | — | 0.1 | 0.45 | 180 | 180 | 20 |
| First layer zone | 150 | 10 | 10 | — | 70 | 2.5 | 0.45 | 100 | 90 | 4.5 |

TABLE 15

| | Gas flow rate (SCCM) | | | | | | Gas pressure (Torr) | RF electric power (W) | Film-forming time (min) | Thickness (μm) |
|---|---|---|---|---|---|---|---|---|---|---|
| | $SiH_4$ | $C_2H_2$ | $H_2$ | $B_2H_6$ (38 ppm) | $B_2H_6$ (0.2%) | NO | | | | |
| Fourth layer zone | 150 | 35 | — | — | — | 0.1 | 0.4 | 150 | 5 | 1 |

TABLE 15-continued

| | Gas flow rate (SCCM) | | | | | | Gas pressure (Torr) | RF electric power (W) | Film-forming time (min) | Thickness (μm) |
|---|---|---|---|---|---|---|---|---|---|---|
| | $SiH_4$ | $C_2H_2$ | $H_2$ | $B_2H_6$ (38 ppm) | $B_2H_6$ (0.2%) | NO | | | | |
| Third layer zone | 150 | 20 | 100 | — | — | 0.1 | 0.5 | 180 | 23 | 3.7 |
| Second layer zone | 150 | 10 | — | 90 | — | 0.1 | 0.45 | 180 | 200 | 21 |
| First layer zone | 150 | 10 | 10 | — | 70 | 2.5 | 0.45 | 100 | 60 | 3 |

The electrophotographic characteristics, such as charge acceptance, photosensitivity and residual potential, were measured with the following results. The photosensitive member produced under the conditions shown in Table 14 was charged by means of a corona charger of −5,6 KV and the photosensitive member produced under the conditions shown in Table 15 was charged by means of a corona charger of +5.6 KV and then subjected to the application of a spectralized monochromatic light (650 nm) to the surface thereof.

| | Photosensitive member produced under the conditions shown in Table 14 | Photosensitive member produced under the conditions shown in Table 15 |
|---|---|---|
| Charge acceptance | −840 V | +960 V |
| Photosensitivity | 0.70 $cm^2erg^{-1}$ | 0.45 $cm^2erg^{-1}$ |
| Residual potential (value after 5 seconds from the start of exposure) | 35 V | 40 V |

In addition, the carbon-content (carbon element-content ratio based on the total sum content of the Si element and the C element) of the first layer zone and the second layer zone were determined by the XMA analysis and the P-content (B-content for the photosensitive member produced under the conditions shown in Table 15) and the oxygen-content of the respective layer zones were determined by the secondary ion mass spectroscopy with the following results:

| | Photosensitive member produced under the conditions shown in Table 14 | Photosensitive member produced under the conditions shown in Table 15 |
|---|---|---|
| First layer zone | | |
| Carbon-content | 23 atomic % | 23 atomic % |
| P-content | 900 ppm | — |
| B-content | — | 1,100 ppm |
| Oxygen-content | 0.5 atomic % | 0.5 atomic % |
| Second layer zone | | |
| Carbon-content | 18 atomic % | 18 atomic % |
| P-content | 15 ppm | — |
| B-content | — | 20 ppm |
| Oxygen-content | $5 \times 10^{-2}$ atomic % | $5 \times 10^{-2}$ atomic % |
| Third layer zone | | |
| Carbon-content | 34 atomic % | 34 atomic % |
| Oxygen-content | $5 \times 10^{-2}$ atomic % | $5 \times 10^{-2}$ atomic % |
| Fourth layer zone | | |
| Carbon-content | 45 atomic % | 45 atomic % |
| Oxygen-content | $5 \times 10^{-2}$ atomic % | $5 \times 10^{-2}$ atomic % |

EXAMPLE 13

An electrophotographic sensitive member was produced under the same conditions as in Table 14 in EXAMPLE 12 excepting that a tank filled with an $O_2$ gas in place of a NO gas was used as the sixth tank (11) and the conditions shown in Table 16 were adopted. Electrophotographic characteristics of the resulting photosensitive member were as follows:

Charge acceptance—850 V
Photosensitivity—0.65 $cm^2$ $erg^{-1}$
Residual potential—37 V

TABLE 16

| | Gas flow rate (SCCM) | | | | | | Gas pressure (Torr) | RF electric power (W) | Film-forming time (min) | Thickness (μm) |
|---|---|---|---|---|---|---|---|---|---|---|
| | $SiH_4$ | $C_2H_2$ | $H_2$ | $PH_3$ (33 ppm) | $PH_3$ (0.2%) | $O_2$ | | | | |
| Fourth layer zone | 150 | 35 | — | — | — | 0.1 | 0.4 | 150 | 5 | 1 |
| Third layer zone | 150 | 20 | 100 | — | — | 0.1 | 0.5 | 180 | 20 | 3 |
| Second layer zone | 150 | 10 | 10 | 100 | — | 0.1 | 0.45 | 180 | 180 | 20 |
| First layer zone | 150 | 10 | 10 | — | 70 | 1.0 | 0.45 | 100 | 90 | 4.5 |

In addition, the carbon-content, the P-content and the oxygen-content of the respective layer zones were measured with the following results:

| | |
|---|---|
| First layer zone | |
| Carbon-content | 23 atomic % |
| P-content | 900 ppm |
| Oxygen-content | 0.8 atomic % |
| Second layer zone | |
| Carbon-content | 18 atomic % |
| P-content | 15 ppm |
| Oxygen-content | $8 \times 10^{-2}$ atomic % |
| Third layer zone | |
| Carbon-content | 34 atomic % |
| Oxygen-content | $8 \times 10^{-2}$ atomic % |
| Fourth layer zone | |
| Carbon-content | 45 atomic % |
| Oxygen-content | $8 \times 10^{-2}$ atomic % |

EXAMPLE 14

An electrophotographic sensitive member was produced under the same conditions shown in Table 15 in EXAMPLE 12 excepting that a tank filled with an $O_2$ gas in place of a NO gas was used as the sixth tank (11) and the conditions shown in Table 17 were adopted. Electrophotographic characteristics of the resulting photosensitive member were as follows:

Charge acceptance—+970 V

Photosensitivity—0.66 $cm^2 erg^{-1}$

Residual potential—40 V

TABLE 17

| | Gas flow rate (SCCM) | | | | | | Gas pressure (Torr) | RF electric power (W) | Film-forming time (min) | Thickness (μm) |
|---|---|---|---|---|---|---|---|---|---|---|
| | $SiH_4$ | $C_2H_2$ | $H_2$ | $B_2H_6$ (38 ppm) | $B_2H_6$ (0.2%) | $O_2$ | | | | |
| Fourth layer zone | 150 | 35 | — | — | — | 0.1 | 0.4 | 150 | 5 | 1 |
| Third layer zone | 150 | 20 | 100 | — | — | 0.1 | 0.5 | 180 | 20 | 3 |
| Second layer zone | 150 | 10 | 10 | 100 | — | 0.1 | 0.45 | 180 | 180 | 20 |
| First layer zone | 150 | 10 | 10 | — | 70 | 1.0 | 0.45 | 100 | 90 | 4.5 |

In addition, the carbon-content, the B-content and the oxygen content of the respective layer zones were measured with the following results:

| | |
|---|---|
| First layer zone | |
| Carbon-content | 23 atomic % |
| B-content | 1,100 ppm |
| Oxygen-content | 0.8 atomic % |
| Second layer zone | |
| Carbon-content | 18 atomic % |
| B-content | 20 ppm |
| Oxygen-content | $8 \times 10^{-2}$ atomic % |
| Third layer zone | |
| Carbon-content | 34 atomic % |
| Oxygen-content | $8 \times 10^{-2}$ atomic % |
| Fourth layer zone | |
| Carbon-content | 45 atomic % |
| Oxygen-content | $8 \times 10^{-2}$ atomic % |

EXAMPLE 15

Photosensitive members were produced in the same manner as in EXAMPLE 13 excepting that the P-content and the oxygen-content of the second layer zone and the oxygen-content of the third layer zone were changed. The image quality of the resulting various kinds of photosensitive member was evaluated with the results as shown in Table 18.

The evaluation of image quality in Table 18 is similar to that in Table 12.

TABLE 18

| Kind of photo-sensitive member | P-content of the second layer zone (ppm) | Oxygen-content of the second layer zone (atomic %) | Oxygen-content of the third layer (atomic %) | Evaluation of image quality |
|---|---|---|---|---|
| 49* | 0 | 0 | $2 \times 10^{-5}$ | Δ |
| 50* | 0 | $2 \times 10^{-5}$ | 0 | Δ |
| 51 | 0 | $1 \times 10^{-4}$ | 0 | ○ |
| 52 | 0 | 0 | $1 \times 10^{-4}$ | ○ |
| 53 | 10 | $2 \times 10^{-3}$ | $2 \times 10^{-3}$ | ◎ |
| 54 | 35 | $1 \times 10^{-2}$ | 0 | ◎ |
| 55 | 80 | $5 \times 10^{-2}$ | $5 \times 10^{-2}$ | ◎ |
| 56 | 180 | 0.5 | $5 \times 10^{-2}$ | ○ |
| 57 | 1300 | 0.8 | 0.3 | ○ |
| 58* | 12000 | 0.8 | $5 \times 10^{-2}$ | X |
| 59* | 180 | 2.0 | 0.3 | X |
| 60* | 35 | $5 \times 10^{-2}$ | 2.0 | X |

As obvious from Table 18, the photosensitive member 51 to 57 according to the present invention exhibited the superior photosensitivity and image concentration and the remarkably reduced or no background smearing.

However, the photosensitive members 49, 50 exhibited the reduced oxygen-content to produce the background smearing in the image. In addition, the photosensitive member 58 exhibited the increased P-content and the photosensitive members 59, 60 exhibited the increased oxygen-content. As a result, both the photosensitive member 58 and the photosensitive members 59, 60 exhibited the reduced image concentration, the inferior photosensitivity and the background smearing in the image.

EXAMPLE 16

Photosensitive members were produced in the same manner as in EXAMPLE 14 excepting that the B-content and the oxygen-content of the second layer zone and the oxygen-content of the third layer zone. The image quality of the resulting various kinds of photosensitive member was evaluated with the results as shown in Table 19.

The evaluation of image quality in Table 19 is similar to that in Table 12.

TABLE 19

| Kind of photo-sensitive member | B-content of the second layer zone (ppm) | Oxygen-content of the second layer zone (atomic %) | Oxygen-content of the third layer (atomic %) | Evaluation of image quality |
|---|---|---|---|---|
| 61* | 3 | 0 | $3 \times 10^{-5}$ | Δ |
| 62* | 3 | $3 \times 10^{-5}$ | 0 | Δ |
| 63 | 3 | $1 \times 10^{-4}$ | 0 | ○ |
| 64 | 3 | 0 | $2 \times 10^{-4}$ | ○ |
| 65 | 15 | $4 \times 10^{-3}$ | $3 \times 10^{-3}$ | ◎ |
| 66 | 45 | $1 \times 10^{-2}$ | 0 | ◎ |
| 67 | 75 | $5 \times 10^{-2}$ | $5 \times 10^{-2}$ | ◎ |
| 68 | 190 | 0.5 | $5 \times 10^{-2}$ | ○ |
| 69 | 1200 | 0.7 | 0.2 | ○ |
| 70* | 15000 | 0.7 | $5 \times 10^{-2}$ | X |
| 71* | 190 | 2.5 | 0.5 | X |
| 72* | 45 | $5 \times 10^{-2}$ | 2.5 | X |

As obvious from Table 19, the photosensitive members 63 to 69 according to the present invention exhibited the superior photosensitivity and image concentration and the remarkably reduced or no background smearing.

However, the photosensitive members 61, 62 exhibited the reduced oxygen-content to produce the background smearing in the image. In addition, the photosensitive member 70 exhibited the increased B-content and the photosensitive members 71, 72 exhibited the increased oxygen-content. As a result, both the photosensitive member 70 and the photosensitive members 71, 72 exhibited the reduced image concentration, the inferior photosensitivity and the background smearing in the image.

EXAMPLE 17

Photosensitive members were produced in the same manner as the photosensitive member 53 in EXAMPLE 15 excepting that the carbon-content of the fourth layer zone was changed. The image quality of the resulting various kinds of photosensitive member was evaluated with the results as shown in Table 20.

TABLE 20

| Kind of photo-sensitive member | Carbon-content of the third layer zone (atomic %) | Carbon-content of the fourth layer zone (atomic %) | Evaluation of image quality |
|---|---|---|---|
| 73 | 34 | 95 | Δ |
| 74 | 34 | 55 | ◎ |
| 75 | 34 | 40 | ◎ |
| 76 | 34 | 23 | X |
| 77 | 34 | 15 | X |

As obvious from Table 20, the photosensitive members 74, 75 exhibited the superior image quality. However, the photosensitive member 73 exhibited the increased carbon-content to produce the background smearing in the image. In addition, the photosensitive members 76, 77 exhibited the reduced carbon-content to be remarkably inferior in image quality.

EXAMPLE 18

Photosensitive members were produced in the same manner as the photosensitive member 65 in EXAMPLE 16 excepting that the carbon-content of the fourth layer zone was changed. The image quality of the resulting various kinds of photosensitive member was evaluated with the results as shown in Table 21.

TABLE 21

| Kind of photo-sensitive member | Carbon-content of the third layer zone (atomic %) | Carbon-content of the fourth layer zone (atomic %) | Evaluation of image quality |
|---|---|---|---|
| 78 | 34 | 93 | Δ |
| 79 | 34 | 53 | ◎ |
| 80 | 34 | 38 | ◎ |
| 81 | 34 | 25 | X |
| 82 | 34 | 17 | X |

As obvious from Table 21, the photosensitive members 79, 80 exhibited the superior image quality. However, the photosensitive member 78 exhibited the increased carbon-content to produce the background smearing in the image. In addition, the photosensitive members 81, 82 exhibited the reduced carbon-content to be remarkably inferior in image quality.

EFFECTS OF THE INVENTION

As above described, according to the present invention, the a-SiC layer having the photoconductivity all over the layer exhibited the high dark resistance and the superior photoconductive characteristics, whereby substantially omitting the surface protective layer and the barrier layer. As a result, the electrophotographic sensitive member comprising the photoconductive a-SiC layer could be provided.

In addition, according to the present invention, the photosensitivity can be improved by containing an appointed quantity of oxygen and also all electrophotographic characteristics can be improved. As a result, the electrophotographic sensitive member having still more enhanced performances can be provided.

Besides, according to the present invention, not only the charge acceptance can be improved and the photosensitivity can be enhanced but also the residual potential can be remarkably reduced by changing the content of the IIIa group elements or the Va group elements or the carbon-content in the direction of layer thickness. As a result, the electrophotographic sensitive member having especially enhanced performances can be provided.

Furthermore, according to the present invention, the positive polar and negative polar electrophotographic sensitive members capable of advantageously charged positively and negatively, respectively, can be provided.

Since the electrophotographic sensitive member according to the present invention is superior in charge acceptance and environment resistance in itself, the protective layer is not specially required. In the case where for example the surface of the photosensitive member is deteriorated by the exposure by the corona discharge, the filming of resinous ingredients of the developer thereon and the like, the initial characteristics of the photosensitive member can be maintained without limiting the quantity of grinding even though the grinding reproduction by means of grinding materials and the like for the deteriorated surface is repeated, whereby the initial good image can be stably provided for a long time.

In addition, the conventional a-Si photosensitive member has shown a problem in that the local discharge destruction is apt to occur on the surface thereof by the corona discharge after the long-term use, whereby producing spots in the image. On the contrary, according to the present invention, since a dielectric constant of a-SiC is 7 about ½ times that of a-Si of 12, a-SiC is superior in charge acceptance, whereby the above described discharge destruction is not produced at all even though the charge acceptance is enhanced. As a result, the electrophotographic sensitive member of high quality and high fidelity can be provided.

Furthermore, comparing the electrophotographic sensitive member according to the present invention with the conventional a-Si photosensitive member, the latter has shown a problem in that the flow of image is apt to be produced due to an inferior moisture resistance and the residual image is produced due to an inferior charge acceptance, and a heater is used to heat the a-Si photosensitive member when used, whereby preventing the above described disadvantages from occurring. On the contrary, the electrophotographic sensitive member according to the present invention is superior in moisture resistance and charge acceptance, so that an advantage occurs in that the above described heater needs not to be used.

In addition, the electrophotographic sensitive member according to the present invention shows advantages in that wide spectral sensitivity characteristics (peak of 600 to 700 nm) and the enhanced photosensitivity itself can be obtained by merely changing the carbon-content in comparison with that of the a-Si photosensitive member and also the sensitivity on the longer wavelength side can be enhanced by doping impurity elements if necessary.

What is claimed is:

1. An electrophotographic sensitive member comprising a photoconductive amorphous silicon carbide layer formed on a substrate, characterized by that said amorphous silicon carbide layer comprises at least a first layer zone and a second layer zone, said first layer zone being disposed closer to the substrate than said second layer zone, the second layer zone containing elements of the group IIIa in the periodic table in a quantity of 0.1 to 10,000 ppm which is smaller than that in the first layer zone, and the second layer zone containing oxygen in a quantity of $5\times10^{-5}$ to 1 atomic %.

2. An electrophotographic sensitive member comprising a photoconductive amorphous silicon carbide layer formed on a substrate, characterized by that said amorphous silicon carbide layer comprises at least a first layer zone and a second layer zone, said first layer zone being disposed closer to the substrate than said second layer zone, the second layer zone containing elements of the group Va in the periodic table in a quantity of 0 to 10,000 ppm which is smaller than that in the first layer zone, and the second layer zone containing oxygen in a quantity of $5\times10^{-5}$ to 1 atomic %.

3. An electrophotographic sensitive member comprising a photoconductive amorphous silicon carbide layer formed on a substrate, characterized by that said amorphous silicon arbide layer comprises at least a first layer zone, a second layer zone and a third layer zone, said first layer zone being disposed closer to the substrate than said second layer zone, the second layer zone being disposed closer to the substrate than said third layer zone, the third layer zone containing carbon in a quantity larger than that in the second layer zone, the second layer zone containing elements of the group IIIa in the periodic table in a quantity of 0.1 to 10,000 ppm which is smaller than that in the first layer zone, and at least one of the second layer zone and the third layer zone containing oxygen in a quantity of $5\times10^{-5}$ to 1 atomic %.

4. An electrophotographic sensitive member comprising a photoconductive amorphous silicon carbide layer formed on a substrate, characterized by that said amorphous silicon carbide layer comprising at least a first layer zone, a second layer zone and a third layer zone, said first layer zone being disposed closer to the substrate than said second layer zone, the second layer zone being disposed closer to the substrate than said third layer zone, the third layer zone containing carbon in a quantity larger than that in the second layer zone, the second layer zone containing elements of the group Va in the periodic table in a quantity of 0 to 10,000 ppm which is smaller than that in the first layer zone, and at least one of the second layer zone and the third layer zone containing oxygen in a quantity of $5\times10^{-5}$ to 1 atomic %.

5. An electrophotographic sensitive member comprising a photoconductive amorphous silicon carbide layer formed on a substrate, characterized by that said amorphous silicon carbide layer comprises at least a first layer zone, a second layer zone, a third layer zone and a fourth layer zone, said first layer zone being disposed closer to the substrate than said second layer zone, the second layer zone being closer to the substrate than said third layer zone, the third layer zone being disposed closer to the substrate than said fourth layer zone, the third layer zone containing carbon in a quantity larger than that in the second layer zone, the fourth layer zone containing carbon in a quantity larger than that in the third layer zone, the second layer zone containing elements of the group IIIa in the periodic table in a quantity of 0.1 to 10,000 ppm which is smaller than that in the first layer zone, and at least one of the second layer zone and the third layer zone containing oxygen in a quantity of $5\times10^{-5}$ to 1 atomic %.

6. An electrophotographic sensitive member comprising a photoconductive amorphous silicon carbide layer formed on a substrate, characterized by that said amorphous silicon carbide layer comprises at least a first layer zone, a second layer zone, a third layer zone and a fourth layer zone, said first layer zone being disposed closer to the substrate than said second layer, the second layer zone being disposed closer to the substrate than said third layer zone, the third layer zone being disposed closer to the substrate than said fourth layer zone, the third layer zone containing carbon in a quantity larger than that in the second layer zone, the fourth layer zone containing carbon in a quantity larger than that in the third layer zone, the second layer zone containing elements of the group Va in the periodic table in a quantity of 0 to 10,000 ppm which is smaller than that in the first layer zone, and at least one of the second layer zone and the third layer zone containing oxygen in a quantity of $5\times10^{-5}$ to 1 atomic %.

* * * * *